US011286820B2

(12) United States Patent
Omori

(10) Patent No.: US 11,286,820 B2
(45) Date of Patent: Mar. 29, 2022

(54) METHOD AND APPARATUS FOR FILLING SILENCER WITH GLASS FIBER

(71) Applicant: CREFACT CO., LTD., Okayama (JP)

(72) Inventor: Yasuo Omori, Okayama (JP)

(73) Assignee: CREFACT CO., LTD., Okayama (JP)

( * ) Notice: Subject to any disclaimer, the term of this patent is extended or adjusted under 35 U.S.C. 154(b) by 0 days.

(21) Appl. No.: 16/616,022

(22) PCT Filed: Oct. 12, 2018

(86) PCT No.: PCT/JP2018/038098

§ 371 (c)(1),
(2) Date: Nov. 22, 2019

(87) PCT Pub. No.: WO2020/075289

PCT Pub. Date: Apr. 16, 2020

(65) Prior Publication Data

US 2021/0363903 A1 Nov. 25, 2021

(51) Int. Cl.

*F01N 1/24* (2006.01)
*F01N 1/04* (2006.01)
*F01N 1/10* (2006.01)

(52) U.S. Cl.

CPC ..... *F01N 1/24* (2013.01); *F01N 1/04* (2013.01); *F01N 1/10* (2013.01); *F01N 2310/02* (2013.01); *F01N 2450/04* (2013.01); *F01N 2450/06* (2013.01)

(58) Field of Classification Search

CPC ... F01N 1/04; F01N 1/10; F01N 1/125; F01N 1/24; F01N 2310/02; F01N 2310/04; F01N 2450/04; F01N 2450/06

See application file for complete search history.

(56) References Cited

U.S. PATENT DOCUMENTS 6,158,547 A * 12/2000 Ackermann ..... F01N 1/24 181/256
6,412,596 B1 * 7/2002 Brandt ..... F01N 1/04 181/252
2009/0110822 A1 * 4/2009 Brandt ..... F01N 1/04 427/238
2016/0208672 A1 * 7/2016 Yamamoto ..... F01N 13/1811

FOREIGN PATENT DOCUMENTS

JP 2004-518063 A 6/2004
JP 2006-009677 A 1/2006
JP 2009-281369 A 12/2009

* cited by examiner

*Primary Examiner* — Jonathan R Matthias

(74) *Attorney, Agent, or Firm* — Pearne & Gordon LLP

(57) ABSTRACT

There is provided a method for filling a silencer with glass fiber, for filling an internal space between a case and an inner pipe with glass fiber in a silencer in which a porous inner pipe penetrates through a pair of through holes in the case, the method including shifting the inner pipe in a penetrating direction from a normal position where the inner pipe is secured to the case, inserting a nozzle auxiliary portion into an interior of the case from a through hole opened by the inner pipe being shifted, supplying glass fiber into the interior of the case from a nozzle of a glass fiber supply machine connected to the nozzle auxiliary portion, and filling the internal space between the case and the inner pipe with glass fiber.

11 Claims, 18 Drawing Sheets

METHOD AND APPARATUS FOR FILLING SILENCER WITH GLASS FIBER

TECHNICAL FIELD

The present disclosure relates to a method and apparatus for filling a silencer with glass fiber, for filling an internal space between a case and an inner pipe with glass fiber in a silencer in which a porous inner pipe penetrates through a pair of through holes in the case.

BACKGROUND

In many cases, a silencer provided on an exhaust pipe has a structure in which an internal space between a metallic inner pipe that penetrates through a metallic case and the case is filled with glass fiber having sound absorption characteristics. Exhaust noise is emitted through a number of holes provided on the inner pipe into an interior of the case and is then absorbed by the glass fiber. Glass wool (short fiber) or glass fiber (long fiber) is used as the glass fiber. Glass wool is solidified with a binder and is installed in the internal space. The glass wool solidified with the binder spreads to an exterior of the case as a result of the binder being liquefied by exhaust heat, thereby contaminating the environment. In the case of glass fiber, the case can be filled directly therewith, thereby suppressing an increase in fabrication costs. As a result, in recent years, the method for filling the internal space with glass fiber has preferably been used (Patent Literature 1 and Patent Literature 2).

The silencer fabrication method disclosed by Patent Literature 1 includes a first process for filling the internal space with fiber material from an open end of the case while air in the interior of the case (outer shell) is discharged from the other end of the inner pipe (Patent Literature 1). In the silencer fabrication method disclosed by Patent Literature 1, following the first process, the interior of the case is drawn to a vacuum (a second step), and outside air is taken through the inner pipe (a third process), so that the fiber material gets homogeneous (Patent Literature 1, [0015], [0016]).

The case disclosed by Patent Literature 1 is assumed to be fabricated through a drawing spinning process since the open end of the case is closed, for example, by narrowing the diameter of the open end after the internal space is filled with the fiber material (Patent Literature 1, [0014]). The case is closed by a cap through which the inner pipe penetrates, and a nozzle of a glass fiber supply machine is inserted into the case from a filling opening portion (a blow-out port) provided in the cap to fill the internal space with the fiber material (Patent Literature 1, [0012]). The fiber material is glass fiber (Patent Literature 1, [0006]).

In the method disclosed by Patent Literature 2, an internal space (an internal cavity) defined between the case (the closed outer shell) and the inner pipe (the holed pipe) is filled with fiber material supplied from at least one filling opening portion provided on the inner pipe (Patent Literature 2). The filling opening portion has a larger inner diameter than a cavity of the inner pipe (Patent Literature 2). While the internal space is being filled with the fiber material, the inner pipe sucks air from a different end portion from an end portion where the filling opening portion is provided to form a flow of air for sucking in the fiber material (Patent Literature 2).

The case disclosed by Patent Literature 2 is assumed to have a separated outer shell structure (a hollow structure) in which a pair of members are combined together because the open end of the case is not closed after the internal space is filled with the fiber material, resulting in the situations where the illustrated structure is laterally asymmetrical (Patent Literature 1, from FIG. 1 onwards). The filling opening portion provided at the end portion of the inner pipe is closed by inserting an end portion of an exhaust pipe (an exhaust pipe) connected to the silencer into the end portion of the inner pipe (Patent Literature 2, [0028]). The fiber material is a continuous strand material made up of a plurality of glass fibers (Patent Literature 2, [0025]).

CITATION LIST

Patent Literature

Patent Literature 1: Japanese Patent Application Laid-open No. 2009-281369

Patent Literature 2: National Publication of International Patent Application No. 2004-518063

SUMMARY

Technical Problem

A structure in which an inner pipe is caused to penetrate through a flat case may be adopted from time to time for silencers due to a limited installation space. In this case, the separated outer shell structure is more preferable than a cylindrical structure that is formed through the drawing spinning process (a metal spinning process). However, the case having the separate outer shell structure is fabricated in such a state that the case is closed completely around the circumference excluding the through holes through which the inner pipe penetrates, and hence, it is difficult to use the method disclosed by Patent Literature 1 (the method including the process for filling the internal space with glass fibers by supplying them from the opening end of the case and the process for closing the opening end after the internal space is filled).

Here, for example, in the case of the case having the separate outer shell structure, it is considered that a filling opening portion through which the nozzle is thrust is provided at a portion of the case and that the filling opening portion is closed after the internal space is filled with glass fibers. However, man-hours or labor hours and costs are necessary to close the filling opening portion. Additionally, should the filling opening portion be opened, there is a risk of the performance of the silencer being unable to be exhibited, which is not preferred. As a result, in the case where glass fibers are supplied to fill the internal space of the silencer using the case having the separated outer shell structure, the method disclosed by Patent Literature 1 cannot be adopted.

On the other hand, in the method disclosed by Patent Literature 2, the nozzle is inserted into the filling opening portion provided at the end portion of the inner pipe to fill the internal space with glass fiber. Thus, this method is considered to be applied even to the silencer using the case having the separated outer shell structure. However, providing the filling opening portion other than the filling opening portion for the purpose of absorbing noise or sound in the inner pipe imposes a problem. According to Patent Literature 2, the filling opening portion is closed by the exhaust pipe that is connected to the inner pipe (Patent Literature 2, [0028]). However, there may be situations where the filling opening portion cannot be closed by the exhaust pipe connected to the inner pipe depending upon the size, shape, and position of the filling opening portion.

In addition, in the method disclosed by Patent Literature 2, since the nozzle is inserted into the filling opening portion with the inner pipe secured to the case, the nozzle and the case, and the inner pipe cannot be rotated relatively around a center axis of the inner pipe. In case the direction of the nozzle relative to the case is fixed, glass fiber is not distributed uniformly in the internal space. Further, in the case of the case having the flat structure, since the cross-sectional area of the internal space changes in a circumferential direction of the inner pipe, the nozzle and the case, and the inner pipe rotate relatively, whereby unless glass fiber is supplied in accordance with the change in the cross-sectional area of the internal space, the glass fiber cannot be distributed uniformly within the internal space.

In this way, the method disclosed by Patent Literature 1 cannot originally be made use of for the silencer using the case having the separate outer shell structure. Then, in the method disclosed by Patent Literature 2, since the nozzle and the case, and the inner pipe cannot be rotated relatively, it is difficult for the glass fiber to be distributed uniformly within the internal space. Then, we have studied methods and apparatuses for filling a silencer with glass fiber which is suitable for filling an internal space in particularly a silencer using a case of a separated outer shell structure and more particularly a method and apparatus for filling a silencer with glass fiber for filling the internal space with glass fiber which is uniformly distributed therein by rotating a nozzle and a case, and an inner pipe relatively.

Solution to Problem

As a result of the studies, there has been developed a method for filling a silencer with glass fiber, for filling an internal space between a case and an inner pipe with glass fiber in a silencer in which a porous inner pipe penetrates through a pair of through holes in the case, the method including shifting the inner pipe in a penetrating direction from a normal position where the inner pipe is secured to the case, inserting a nozzle auxiliary portion into an interior of the case from a through hole opened by the inner pipe being shifted, supplying glass fiber into the interior of the case from a nozzle of a glass fiber supply machine connected to the nozzle auxiliary portion, and filling the internal space between the case and the inner pipe with glass fiber.

The method for filling a silencer with glass fiber according to the present disclosure is used for a silencer in which a linear inner pipe penetrates through a case. Due to this, the method can also be applied, for example, to a silencer in which a case has a cylindrical structure, provided that a linear inner pipe penetrates through the case. The method for filling a silencer with glass fiber according to the present disclosure obviates the necessity of providing a filling opening portion in the case and the inner pipe and is made use of for a silencer having a separated outer shell structure. The silencer in which the internal space is filled with the glass fiber completely is completed by returning the inner pipe to the normal position to be secured to the case again.

There is imposed no limitation on the structure or configuration of the nozzle auxiliary portion, provided that with the nozzle auxiliary portion kept inserted into the interior of the case from the through hole, glass fiber can be supplied into the interior of the case from the nozzle of the glass fiber supply machine. At least one nozzle of the glass fiber supply machine is connected to the nozzle auxiliary portion. In case a plurality of nozzles of the glass fiber supply machine can be connected to the nozzle auxiliary portion, such a plurality of nozzles may be connected to the nozzle auxiliary portion. The nozzle auxiliary portion is inserted from the through hole after the inner pipe is shifted, is inserted from the through hole at the same time as the inner pipe is shifted, or is inserted from the through hole while one end of the inner pipe is being pushed.

When inserted into the interior of the case from the through hole, the nozzle auxiliary portion is detachably connected to one end of the inner pipe that remains in the interior of the case to thereby support the inner pipe that is separated from the through hole. As long as the nozzle auxiliary portion can detachably be connected to the one end of the inner pipe, there is imposed no limitation on the connection form. For example, a chuck device may be provided on the nozzle auxiliary portion, the chuck device being configured to hold the one end of the inner pipe in association with a lifting action of the nozzle auxiliary portion towards the through hole. Additionally, since the inner pipe only needs to be supported, for example, a distal end portion of the nozzle auxiliary portion that is inserted from the through hole only has to be thrust against the one end of the inner pipe.

Similarly, when inserted into the interior of the case from the through hole, the nozzle auxiliary portion is detachably connected to the through hole in the case that is opened by shifting the inner pipe to thereby support the case in which the inner pipe is separated from the through hole. As long as the nozzle auxiliary portion can detachably be connected to the through hole, there is imposed no limitation on the connection form. For example, a chuck device may be provided on the nozzle auxiliary portion, the chuck device being configured to hold an edge of the through hole in association with a lowering action of the nozzle auxiliary portion towards the through hole. Additionally, since the nozzle auxiliary portion only needs to be able to support the case, for example, the nozzle auxiliary portion only needs to be inserted from the through hole to be fitted in the through hole by causing a cross-sectional shape of the nozzle auxiliary portion to coincide with a shape of the through hole (normally, a circular shape).

The nozzle auxiliary portion may be configured as follows. When inserted into the interior of the case from the through hole, the nozzle auxiliary portion closes the one end of the inner pipe that is situated in the interior of the case and the through hole in the case that is opened by shifting the inner pipe and forms a flow of air for sucking in glass fiber by sucking out air in the interior of the case through holes on the inner pipe from the other end of the inner pipe that is situated outside the case to thereby supply glass fiber. The nozzle auxiliary portion does not have to close the through hole in the case completely, and hence, even though a slight amount of air is sucked in from a gap between the through hole and the nozzle auxiliary portion, a flow of air for sucking in glass fiber only needs to be formed.

There is imposed no limitation on the way in which the nozzle auxiliary portion closes the one end of the inner pipe and the through hole in the case. For example, a one end closing portion and a through hole closing portion which operate separately may be provided, and the one end closing portion and the through hole closing portion are caused to operate after the nozzle auxiliary portion is inserted from the through hole, whereby the one end of the inner pipe and the through hole in the case is closed. Alternatively, an external portion of the nozzle auxiliary portion may be configured as a one end closing portion and a through hole closing portion, whereby the one end of the inner pipe is closed by the one end closing portion, and the through hole is closed by the through hole closing portion of the nozzle auxiliary portion inserted from the through hole.

In supplying glass fiber from the nozzle, when the case and the inner pipe are rotated around a center axis of the inner pipe, the nozzle of the glass fiber supply machine connected to the nozzle auxiliary portion and the case, and the inner pipe can be rotated relatively. The nozzle auxiliary portion may also be rotated around the center axis of the inner pipe. In this case, the rotation of the case and the inner pipe may coincide with or differ from the rotation of the nozzle auxiliary portion in terms of rotational direction and rotation speed. However, the nozzle and the case, and the inner pipe can be rotated relatively as long as the case and the inner pipe can rotate, even though the nozzle auxiliary portion remains fixed in position, which is sufficient.

Based on the present disclosure, there is provided an apparatus for filling a silencer with glass fiber, for filling an internal space between a case and an inner pipe with glass fiber in a silencer in which a porous inner pipe penetrates through a pair of through holes in the case, the apparatus including a silencer support portion configured to hold the case and the inner pipe in such a state that the inner pipe is directed in an up-down direction and is shifted downwards from a normal position where the inner pipe is secured to the case to take an erected posture, and a nozzle auxiliary portion that is inserted into an interior of the case from above through a through hole opened by the inner pipe being shifted, the silencer support portion and the nozzle auxiliary portion being provided on an apparatus frame, and in the apparatus, a nozzle of a glass fiber supply machine is connected to the nozzle auxiliary portion.

In the apparatus for filling a silencer with glass fiber according to the present disclosure, the case and the inner pipe are held in the erected posture, and the nozzle auxiliary portion to which the nozzle of the glass fiber supply machine is connected is inserted from the opened through hole in the case for supplying glass fiber into the internal space from the nozzle. Since the case and the inner pipe are held in the erected posture, glass fiber can be supplied at all times under the constant gravity environment irrespective of the circumferential position of the inner pipe and the height of the inner pipe in relation to the penetrating direction thereof. The inner pipe held in the erected posture is not affected by the gravitational force thereof and can be shifted from the normal position and returned thereto by moving in the up-down direction without being inclined.

The silencer support portion may include a support table configured to support from below the other end of the inner pipe that is situated outside the case and a bottom surface of the case and a holding frame configured to hold a side surface of the case. Since the case and the inner pipe are prevented from being inclined or falling down by the holding frame, the case and the inner pipe only need to be rested on the support table. In case the inner pipe deviates, the other end that projects downwards from the case is supported by the support table. The holding frame only needs to be able to support the side surface of the case, and a frame member having a collapsed U-like shape in a plan view and including a pair of abutment portions situated in positions which are point symmetric with each other can be raised as an example of the holding frame. The support table and the holding frame may be provided independently of each other on the apparatus frame. Alternatively, for example, with the holding frame erected on the support table, the support table may be provided directly on the apparatus frame, while the holding frame may be provided on the apparatus frame via the support table.

The silencer support portion may be provided on the apparatus frame via a support portion rotating device and may be rotated around a center axis of the inner pipe by the support portion rotating device. As a result, the case and the inner pipe that are held by the silencer support portion rotate, whereby the nozzle of the glass fiber supply machine that is connected to the nozzle auxiliary portion and the case, and the inner pipe can be rotated relatively. There is imposed no limitation on the structure or configuration of the silencer support portion, provided that the silencer support portion can maintain the erected posture of the case and the inner pipe that are rotating. For example, the silencer support portion resulting from combining the support table and the holding frame together can rotate stably the case and the inner pipe around the center axis of the inner pipe. A turn table on which the silencer support portion is rested can be illustrated as an example of the rotating device.

The silencer support portion may include a pipe receiver configured to support from below the other end of the inner pipe that is situated outside the case, and the pipe receiver may include a pipe lifting device configured to rise in returning the inner pipe to the normal position. The pipe lifting device may be incorporated in the pipe receiver or may be interposed between the pipe receiver and a main body portion constituting the silencer support portion or the apparatus frame. The pipe lifting device may have an additional function of lifting down the inner pipe when the inner pipe is lifted down to be shifted from the normal position. An elastic member that extends and contracts or a power-driven lifting table (an elevator) can be illustrated as an example of the pipe receiver on which the pipe lifting device is provided.

The pipe receiver including the pipe lifting device which is made up of the elastic member is pushed by, for example, the nozzle auxiliary portion connected to the inner pipe and is lowered with the elastic member contracted to support the other end of the inner pipe shifted downwards from the normal position. The pipe receiver is raised with the elastic member extended when the nozzle auxiliary portion moves away from the inner pipe, allowing the inner pipe to be returned to the normal position. In this way, in the case where the pipe receiver includes the pipe lifting device which is made up of the elastic member, for example, when the inner pipe is released from the pushed state by the nozzle auxiliary portion, the pipe receiver raises the inner pipe automatically by use of the reaction force thereof.

The pipe receiver including the pipe lifting device which is made up the power-driven lifting table, for example, lowers the lifting table in advance to shift the inner pipe that is not secured to the case downwards from the normal position and supports the other end of the inner pipe. The pipe receiver raises the lifting table when the nozzle auxiliary portion moves away from the inner pipe, allowing the inner pipe to be returned to the normal position. Since the inner pipe is restricted from moving downwards by the pipe receiver on which the other end thereof is rested, the inner pipe cannot be shifted from the normal position with the pipe receiver raised.

The nozzle auxiliary portion may be provided on the apparatus frame via an auxiliary portion lifting device and may be lifted down towards the through hole in the case that is opened by the inner pipe being shifted by the auxiliary portion lifting device. The nozzle auxiliary portion is preferably lifted down rectilinearly towards the through hole into which the nozzle auxiliary portion is inserted from above the through hole. In this case, for example, a configuration can be illustrated in which a linear cylinder configured to extend a rod downwards and contract the rod upwards is provided on the apparatus frame and the nozzle auxiliary portion is attached to an end of the rod. The nozzle auxiliary portion may be lifted up or down with the nozzle of the glass fiber supply machine kept connected at all times, or the nozzle may be connected to the nozzle auxiliary portion at a stage where the nozzle auxiliary portion is lowered to be inserted into the through hole.

The nozzle auxiliary portion may include a one end closing portion configured to close one end of the inner pipe that is situated in an interior of the case and a through hole closing portion configured to close the through hole in the case that is opened by shifting the inner pipe, the silencer support portion may include an air suction device that communicates with the other end of the inner pipe that is situated outside the case, and in supplying glass fiber from the nozzle, air in the interior of the case may be sucked out via holes in the inner pipe by the air suction device to form a flow of air for sucking glass fiber in such a state that the nozzle auxiliary portion closes the one end of the inner pipe that is situated in the interior of the case by use of the one end closing portion and the through hole in the case that is opened by shifting the inner pipe by use of the through hole closing portion.

There is imposed no limitation on the structure and configuration of the one end closing portion and the through hole closing portion, provided that the nozzle auxiliary portion can close the one end of the inner pipe and the through hole in the case. For example, a one end closing portion and a through hole closing portion that operate separately are provided on the nozzle auxiliary portion, and the one end closing portion and the through hole closing portion are operated after the nozzle auxiliary portion is inserted into the case from the through hole to close the one end of the inner pipe and the through hole in the case. Additionally, an external portion of the nozzle auxiliary portion is formed as a one end closing portion and a through hole closing portion, so that the one of the inner pipe is closed by the one end closing portion and the through hole in the case is closed by the through hole closing portion of the nozzle auxiliary portion that is inserted into the case from the through hole.

Advantageous Effects of Invention

The method for filling a silencer with glass fiber according to the present disclosure fills the internal space with glass fiber without providing a filling opening portion in the case and the inner pipe. Since no filling opening portion is provided in the case and the inner pipe, the method for filling a silencer with glass fiber according to the present disclosure can also be made use of for a silencer having the separated outer shell structure. In the silencer having the separated outer shell structure, when glass fiber is supplied to fill the internal space by making use of the method for filling a silencer with grass fiber according to the present disclosure, a superior aesthetic external appearance is provided by providing no filling opening portion, and there is no risk of producing an unnecessary opening in the case as time goes by.

When the nozzle auxiliary portion is connected to the one end of the inner pipe and the nozzle auxiliary portion is connected to the through hole in the case, the postures of the inner pipe and the case are stabilized while glass fiber is being supplied, thereby making it possible to prevent the deformation of the internal space. As a result, a generation of a gap between the inner pipe and the glass fiber that fills the internal space can be avoided. Additionally, in the case where the nozzle auxiliary portion has a cylindrical structure having the same diameter as that of the inner pipe, glass fiber fills only the internal space between the inner pipe and the case, whereby there is no risk of the inner pipe is caught by the glass fiber when the inner pipe is returned to the normal position.

When the nozzle auxiliary portion closes the one end of the inner pipe and the through hole in the case to form the flow of air for sucking glass fiber and glass fiber is supplied from the nozzle, glass fiber can fill the internal space with high bulk density. Additionally, when the case and the inner pipe are rotated around the center axis of the inner pipe, glass fiber can be supplied in such a manner as to be distributed uniformly in the internal space. The method for filling a silencer with glass fiber according to the present disclosure provides an advantageous effect of filling the internal space of the silencer using the case having the separated outer shell structure with glass fiber uniformly and with high bulk density.

In the apparatus for filling a silencer with glass fiber according to the present disclosure, since glass fiber is supplied into the interior of the case while the case is held in the erected posture in which the inner pipe is directed in the up-down direction, glass fiber is allowed to fill the internal space uniformly while preventing the deviation of the effect of gravity. Since the silencer support portion made up of the support table and the holding frame stably holds the case and the inner pipe in the erected posture, the heights of the one end of the inner pipe and the through hole in the case are specified, the nozzle auxiliary portion is allowed to be easily inserted into the through hole while maintaining the predetermined positional relationship. The holding frame prevents the case from being inclined or falling down and enhances the stability of the case and the inner pipe which are held in the erected posture, helping glass fiber fill the internal space uniformly. The support table allows the other end of the inner pipe that projects from the case to be brought into engagement with the corresponding location on the support table to thereby prevent the deviation of the case and the inner pipe.

In the apparatus for filling a silencer with glass fiber according to the present disclosure, the support portion rotating device is provided on the silencer support portion that supports the case and the inner pipe. Then, when the silencer support portion is rotated, the nozzle of the glass fiber supply machine, and the case and the inner pipe are rotated relatively, whereby glass fiber is allowed to fill the internal space uniformly. In addition, in the method for filling a silencer with glass fiber according to the present disclosure, the pipe lifting device is provided on the pipe receiver of the silencer support portion, so that the work of returning the inner pipe to the normal position is automated by the pipe receiver that is caused to be lifted up or down by the pipe lifting device, whereby the inner pipe is prevented from deviating from the normal position.

The nozzle auxiliary portion, which is provided on the apparatus frame via the auxiliary portion lifting device and is lifted down towards or lifted up from the through hole in the case, automates the process of inserting the nozzle auxiliary portion into and drawing the nozzle auxiliary portion out of the through hole. When the nozzle auxiliary portion connects to the one end of the inner pipe and the through hole, the positional relationship with the one end of the inner pipe and the through hole is specified, whereby the nozzle auxiliary portion can connect thereto stably and in an ensured fashion. When the nozzle auxiliary portion closes the one end of the inner pipe and the through hole, the positional relationship with the one end of the inner pipe and the through hole is specified, whereby the nozzle auxiliary portion can close the one end of the inner pipe and the through hole in an ensured fashion. Once the one end of the inner pipe and the through hole are closed, a positional deviation of the case or the inner pipe can be corrected.

In the apparatus for filling a silencer with glass fiber according to the present disclosure, the one end closing portion for closing the one end of the inner pipe and the through hole closing portion are provided on the nozzle auxiliary portion, and the air suction device that communicates with the other end of the inner pipe is provided on the silencer support portion. With this apparatus, the one end of the inner pipe and the through hole are closed to form the flow of air for sucking in glass fiber, thereby making it possible to allow glass fiber to fill the internal space with the high bulk density. With the apparatus for filling a silencer with glass fiber according to the present disclosure, since the nozzle auxiliary portion to which the nozzle of the glass fiber supply machine is connected can be made use of as the closing device for closing the case, when glass fiber is ready to be supplied into the interior of the case from the nozzle, the flow of air for sucking in glass fiber can be formed by the air suction device.

DETAILED DESCRIPTION OF THE EMBODIMENTS

Figure 9:
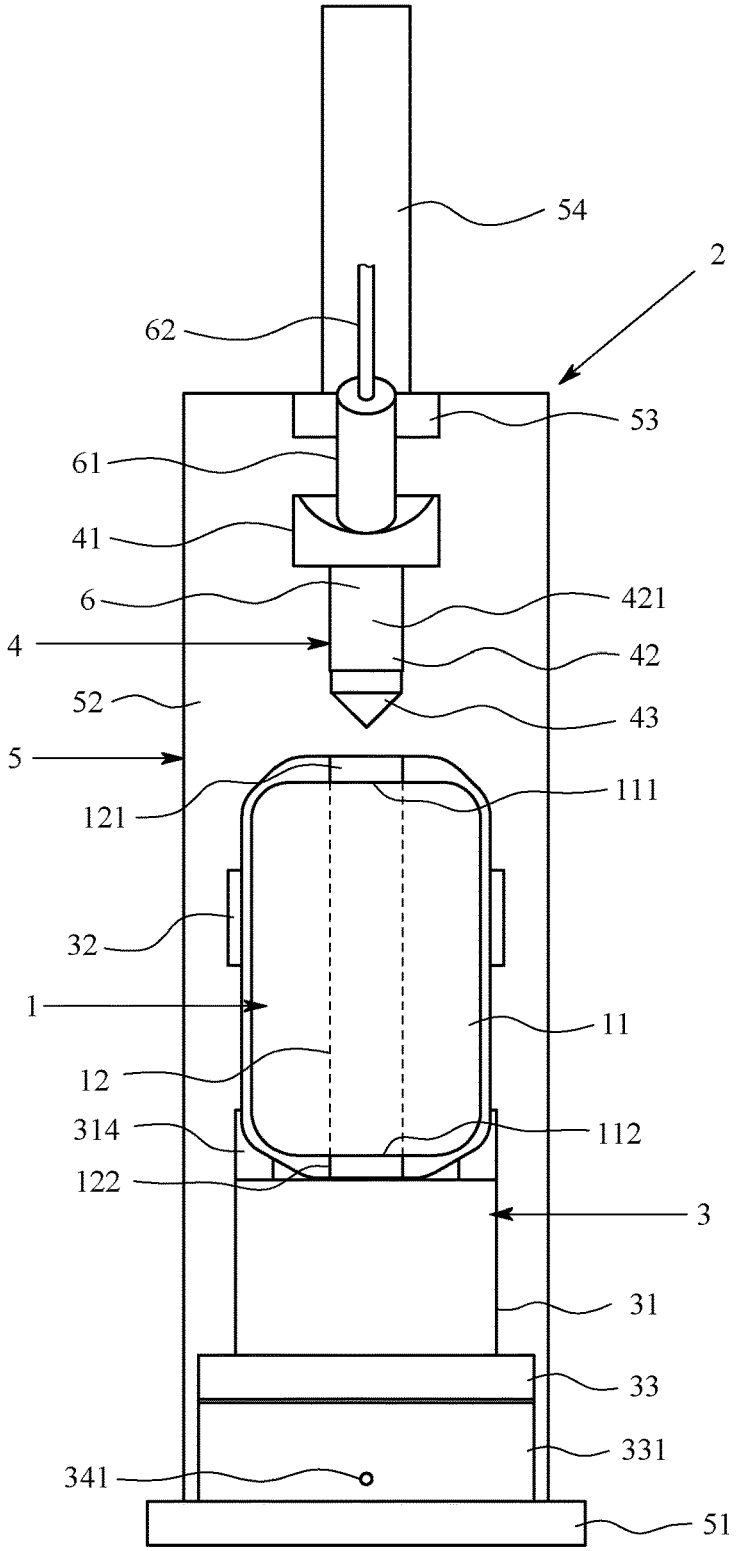
FIG. 9 is a front view of the apparatus for filling a silencer with glass fiber according to the present example, representing a state where a silencer is rested on a silencer support portion.
Figure 10:
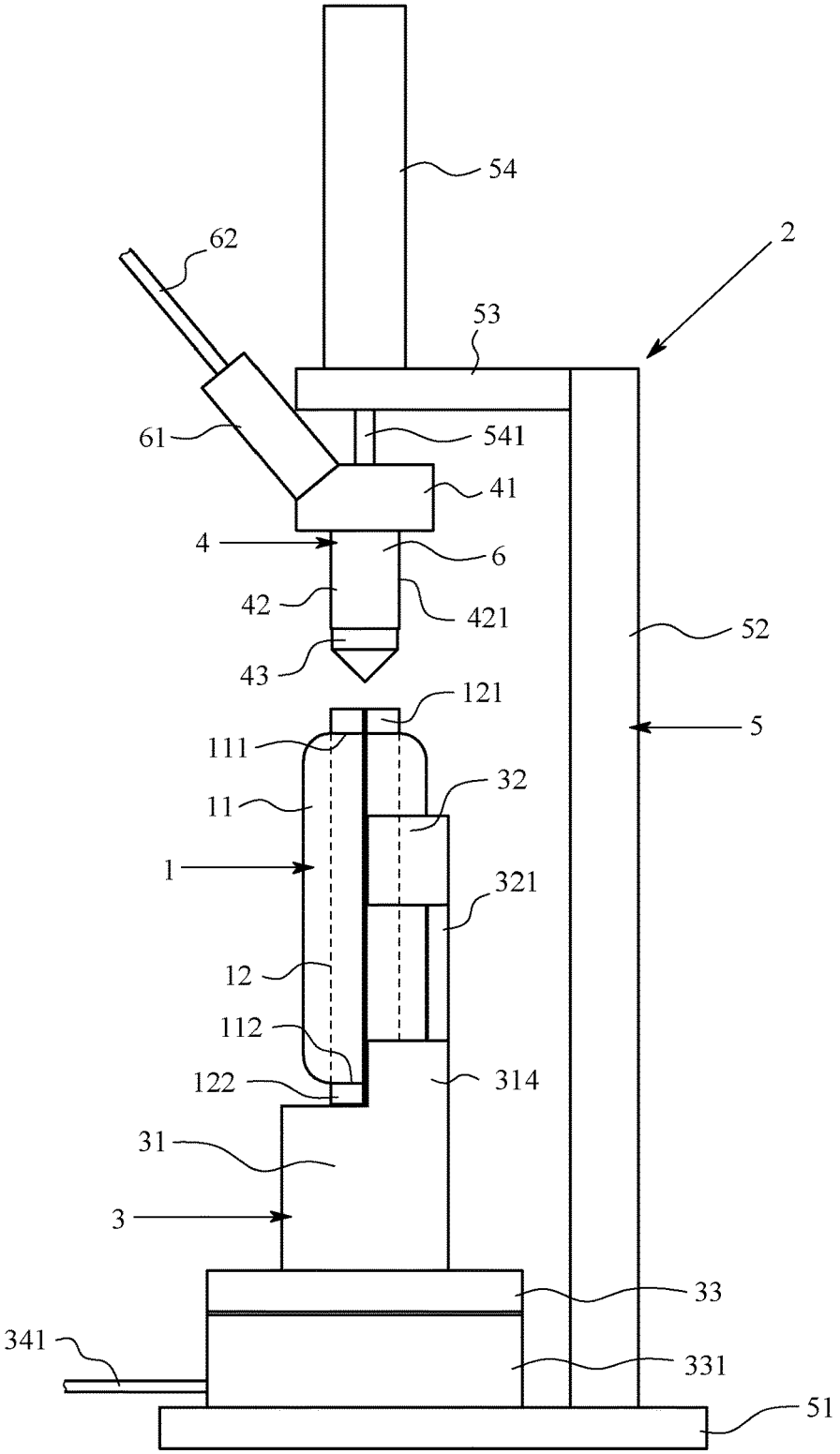
FIG. 10 is a right side view of the apparatus for filling a silencer with glass fiber according to the present example, representing a state where the silencer is rested on the silencer support portion.

Hereinafter, referring to figures, a mode for carrying out the present disclosure will be described. An apparatus for filling a silencer with glass fiber 2 to which the present disclosure is applied includes, for example, as illustrated in FIGS. 1 to 4, a silencer support portion 3 including in turn a support table 31 on which a silencer 1 (refer to from FIG. 9 onwards which will be illustrated later) is rested and a holding frame 32 configured to hold the silencer 1 from sides thereof and a nozzle auxiliary portion 4 configured to move towards from above and away from the silencer 1 that is held in an erected posture by the silencer support portion 3, and the silencer support portion 3 and the nozzle auxiliary portion 4 are provided on an apparatus frame 5. A nozzle 6 of a glass fiber supply machine (whose illustration is omitted) is fixed to the nozzle auxiliary portion 4 and is lifted up and down together with the nozzle auxiliary portion 4.

The apparatus frame 5 is configured so that a vertical wall 52 is erected along a rear edge of a flat base 51, and a horizontal arm 53 projects to the front from an upper edge of the vertical wall 52. The base 51 includes a turn table 33 disposed at the front of the vertical wall 52 and the silencer support portion 3 provided on the turn table 33. A direction action cylinder 54 configured to extend a rod 541 downwards and contract the rod 541 upwards is attached to the horizontal arm 53. The nozzle auxiliary portion 4 is supported at a lower end of the rod 541 and is lifted up and down by use of the direction action cylinder 54 as an auxiliary portion lifting device.

The turn table 33 includes a motor portion 331 disposed there below and is rotated by receiving a rotational power directly from a drive motor. The turn table 33 of the present example allows a suction pipe 34, which is erected along a rotational center from a suction tube 341 that is inserted into the motor portion 331 from the front, to penetrate therethrough upwards. An air suction device according to the present example is made up of the suction pipe 34 and the suction tube 341, and a suction pump (whose illustration is omitted) to which the suction tube 341 is coupled.

The silencer support portion 3 is made up of the cylindrical support table 31 that is rested on the turn table 33 while being aligned concentrically with the turn table 33 and the holding frame 32 constituting a frame member having a U-like shape in a plan view and supported by a coupling strut 321 that extends upwards from the support table 31. The support table 31 is integral with the holding frame 32, and since the support table 31 is provided on the turn table 33, the support table 31 and the holding frame 32 rotate together. In this way, in the apparatus for filling a silencer with glass fiber 2 according to the present example, the turn table 33 constitutes a support portion rotating device.

The support table 31 includes a case receiver 314 having an inner surface that follows an end face of a case 11 (refer to from FIG. 9 onwards which will be illustrated later on) of the silencer 1, and this case receiver 314 is provided on an upper surface of the support table 31 in a position lying closer to a rear surface side thereof. The silencer 1 rested on the silencer support portion 3 is supported stably while maintaining its erected posture with the end face of the case 11 staying in surface contact with the case receiver 314 and side surfaces of the case 11 held by the holding frame 32. In this way, as long as the silencer 1 is supported stably while maintaining its erected posture, there is imposed no limitation on the structure of the case receiver 314. In addition, providing the case receiver 314 is not always necessary.

Figure 1:
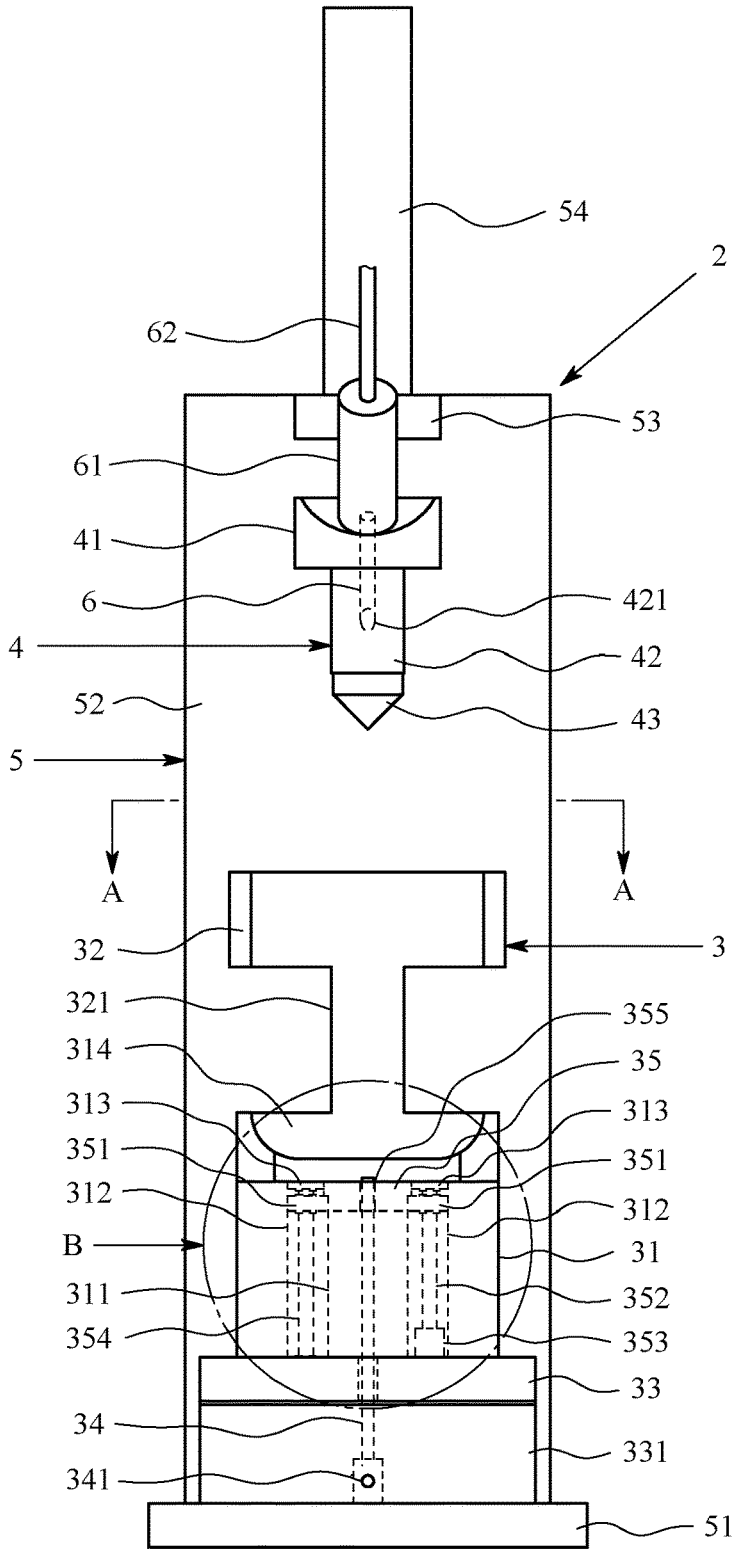
FIG. 1 is a front view representing one example of an apparatus for filling a silencer with glass fiber according to the present disclosure.
Figure 2:
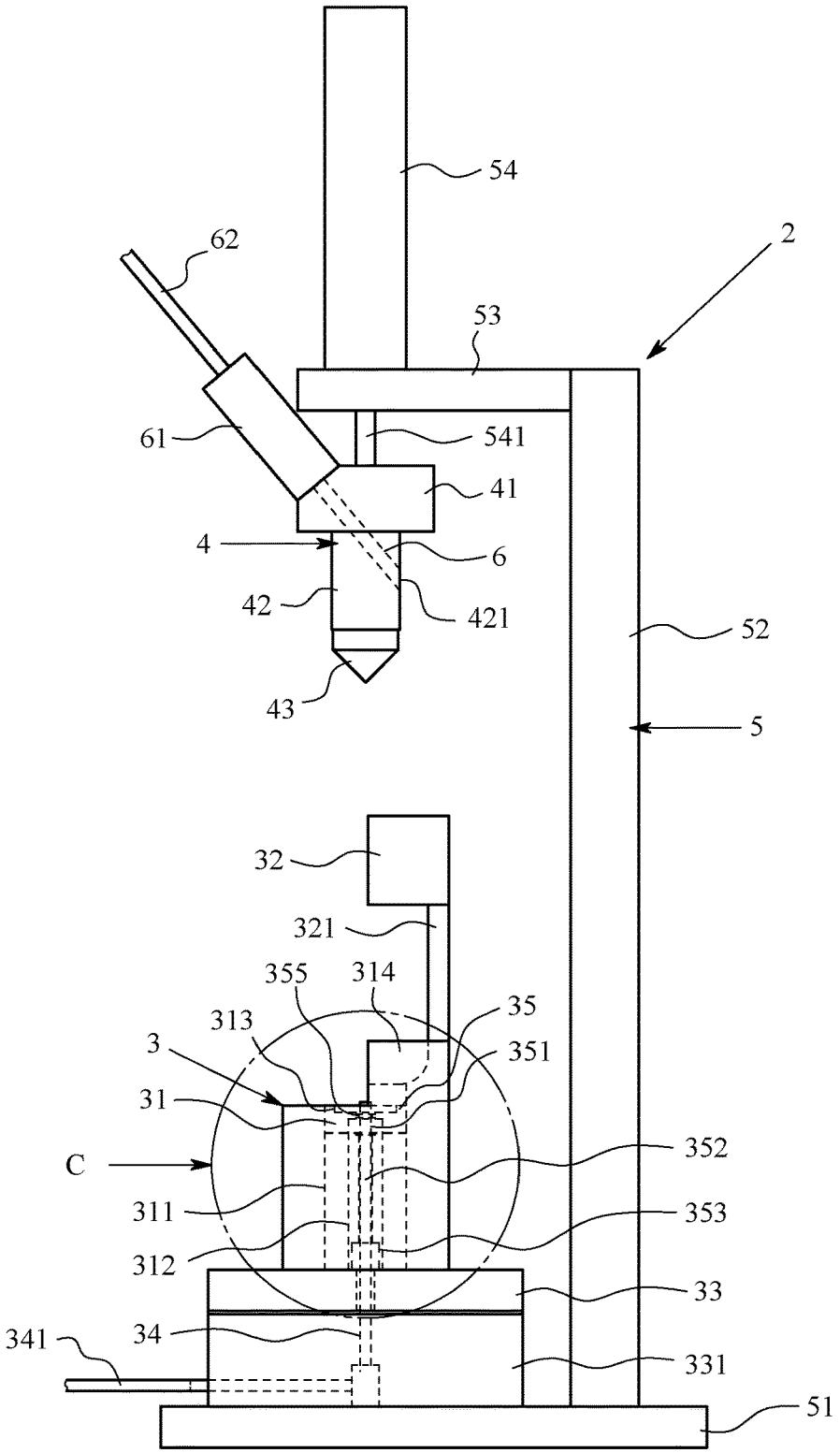
FIG. 2 is a right side view of the apparatus for filling a silencer with glass fiber according to the present example.
Figure 3:
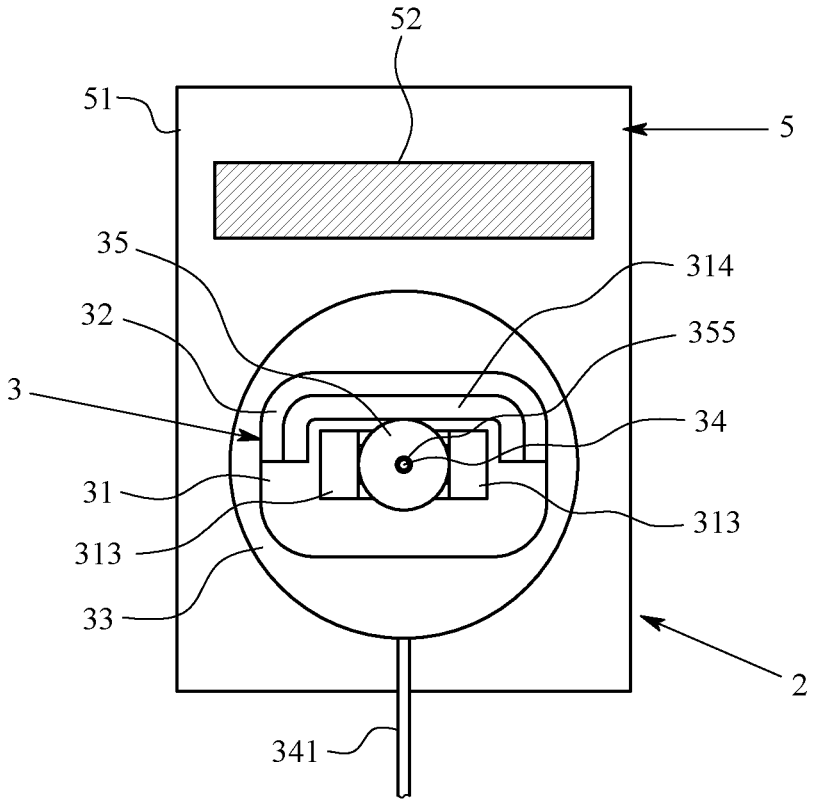
FIG. 3 is a cross-sectional view taken along a line A-A in FIG. 1.
Figure 4:
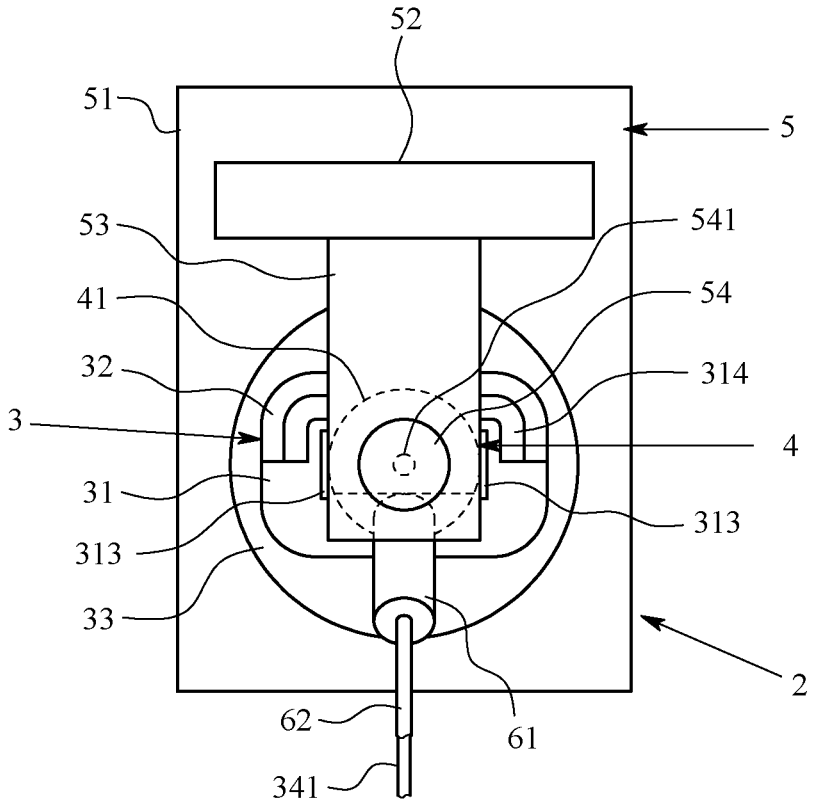
FIG. 4 is a plan view representing the apparatus for filling a silencer with glass fiber according to the present example.
Figure 5:
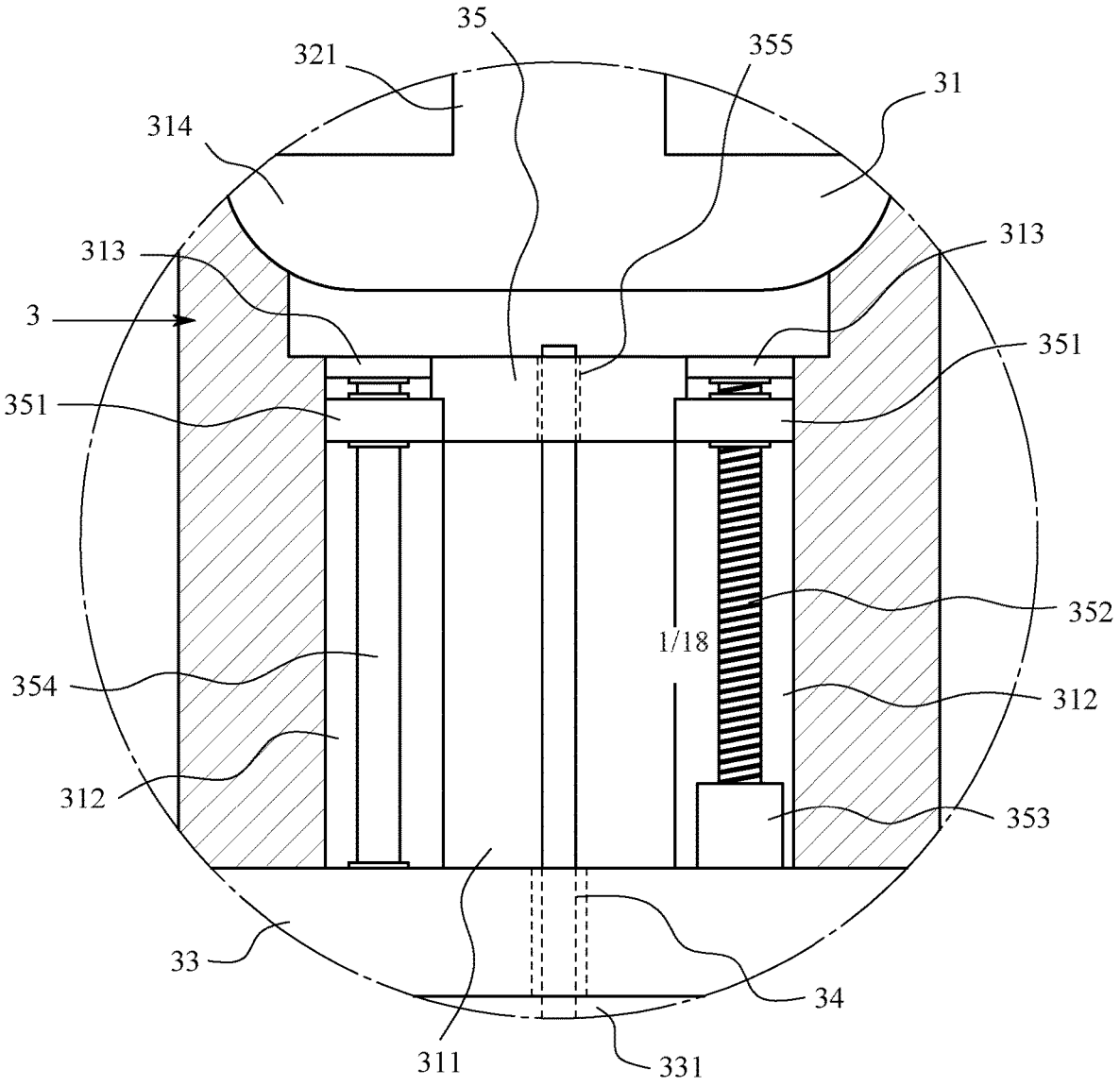
FIG. 5 is a partially cut away enlarged view of a portion indicated by an arrow B in FIG. 1.
Figure 6:
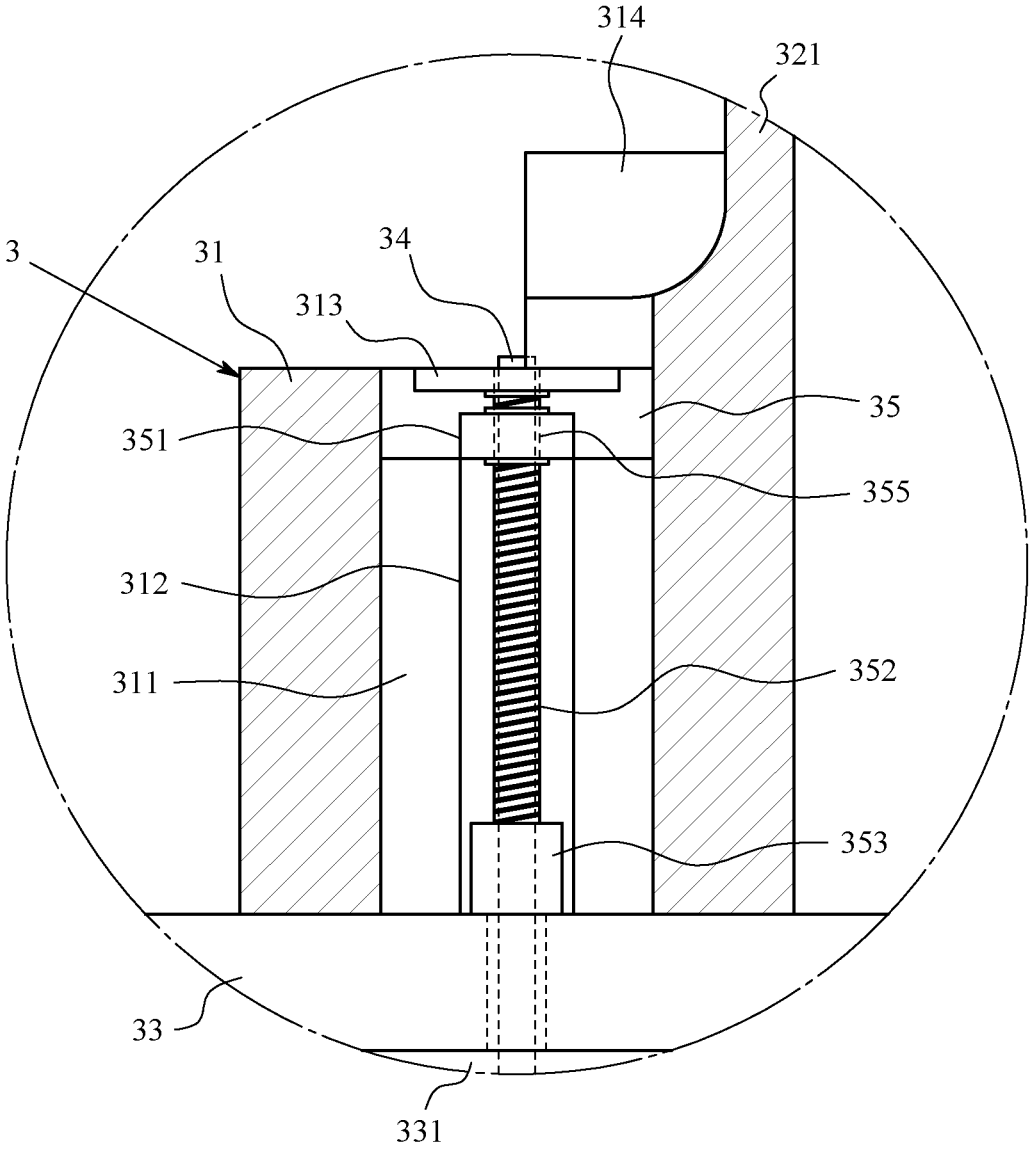
FIG. 6 is a partially cut away enlarged view of a portion indicated by an arrow C in FIG. 2.

The support table 31 of the present example includes a pipe receiver 35 that is lowered or lifted downwards from a height level with an upper surface of the support table 31 (refer to FIGS. 5 and 6). The pipe receiver 35 is a flat metallic disk and has a pair of lifting flanges 351 that projects laterally therefrom and a pipe hole 355 that is provided at a center of the pipe receiver 35 in such a manner as to penetrate therethrough vertically. The support table 31 includes a lifting hole 311 constituting a track of the pipe receiver 35 and lifting grooves 312 constituting tracks of the lifting flanges 351. The suction pipe 34 remains almost within the pipe receiver 35 and hence does not project from the pipe receiver 35 that is level with the upper surface of the support table 31. When the pipe receiver 35 is lowered, the suction pipe 34 projects from the pipe receiver 35.

The right lifting groove 312 includes a lifting motor 353 provided at a bottom thereof and incorporates a ball screw 352 that is rotated by the lifting motor 353. The ball screw 352 is brought into thread engagement with the right lifting flange 351 and is supported on a groove lid 313 that closes the right lifting groove 312 at an upper end thereof. The left lifting groove 312 incorporates a lifting guide 354 that is made up of a metallic pipe. The lifting guide 354 extends through the left lifting flange 351 and is supported on a groove lid 313 that closes the left lifting groove 312 at an upper end thereof.

When the ball screw 352 rotates, the right lifting flange 351 left in thread engagement with the ball screw 352 is moved up or down whereby the pipe receiver 35 is lifted up or down in the lifting hole 311. The lifting guide 354 moves the left lifting flange 351 up or down, enabling the pipe receiver 35 to be lifted up or down stably. The pipe receiver 35 of the present example is lowered after the silencer 1 is rested on the silencer support portion 3 and before glass fiber 63 (refer to FIGS. 15 and 16, which will be described later on) starts to be supplied and shifts an inner pipe 12 (refer to from FIG. 9 onwards, which will be illustrated later on). Additionally, the pipe receiver 35 raises the inner pipe 12 of the silencer 1 to return the inner pipe 12 to the normal position after filling of glass fiber 14 (refer to FIGS. 15 and 16, which will be illustrated later on) is completed.

Figure 7:
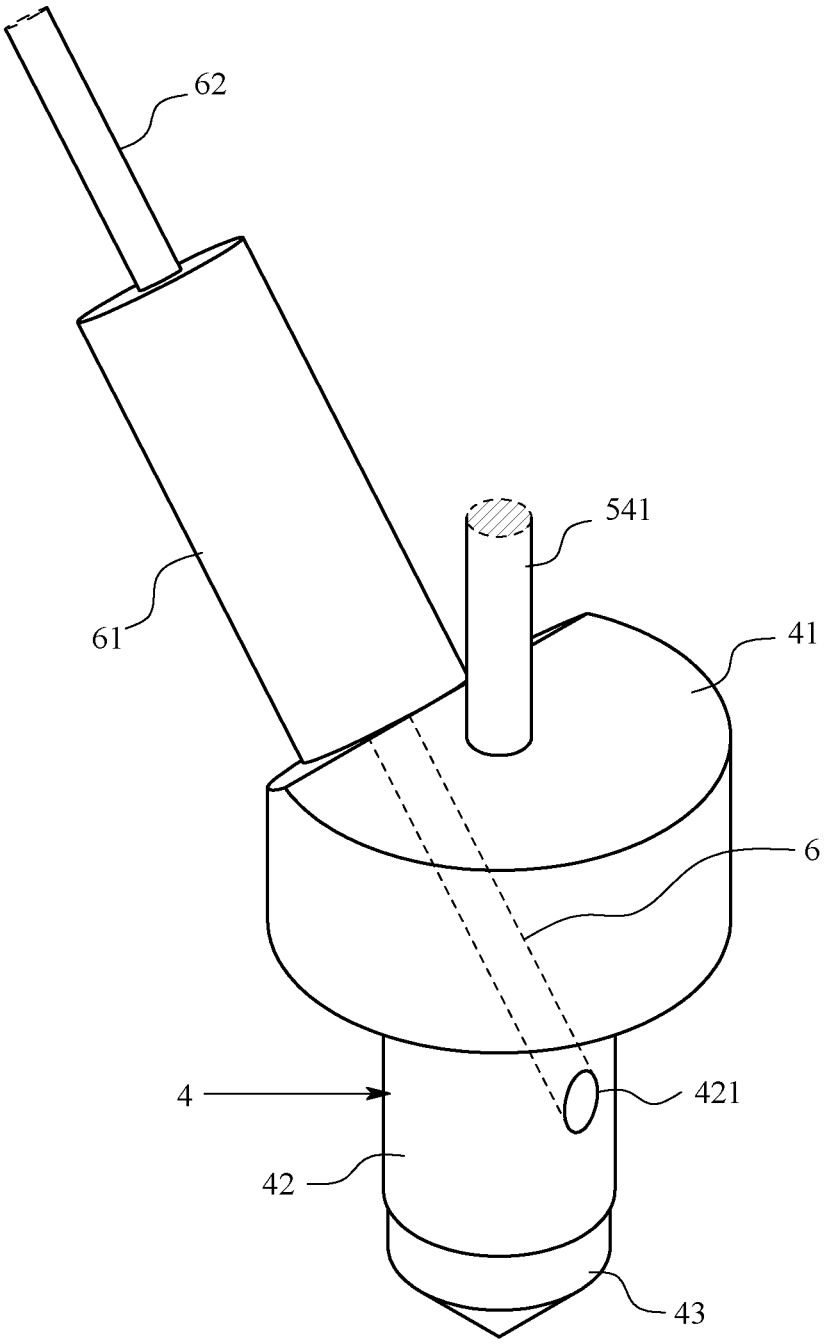
FIG. 7 is a perspective view of a nozzle auxiliary portion as seen from the rear.

The nozzle auxiliary portion 4 constitutes a metallic block (refer to FIG. 7) in which a stopper portion 41 configured to be brought into engagement with an upper edge of the case 11 of the silencer 1 to restrict the nozzle auxiliary portion 4 from being lowered any further, a cylindrical auxiliary portion main body portion 42 that extends downwards from a lower surface of the stopper portion 41, and an end portion 43 having a downwardly projecting conical structure provided at a lower end of the auxiliary portion main body portion 42 are provided integrally and sequentially in that order that. The rod 541 of the linear cylinder 54 that is fixed to the apparatus frame 5 is connected to an upper surface of the stopper portion 41, whereby the nozzle auxiliary portion 4 is lifted downwards and upwards as the rod 541 extends and contracts, respectively.

The stopper portion 41 constitutes a metallic disk having an outside diameter greater than a through hole 111 at an upper side of the case 1. In the present example, in order to hold the nozzle 6 of the glass fiber supply machine that connects to the stopper portion 41 while maintaining a posture produced when the nozzle 6 is inserted from a front obliquely upper portion, a chamfered portion is provided at a front upper edge of the stopper portion 41 so that a lower end face of a nozzle main body portion 61 from which the nozzle 6 is caused to project is brought into oblique abutment with the stopper portion 41. The nozzle 6 is inserted through the nozzle auxiliary portion 4 from the stopper portion 41 to the auxiliary portion main body portion 42, whereby the nozzle 6 is supported in the nozzle auxiliary portion 4 stably.

The auxiliary portion main body portion 42 constitutes a metallic cylinder having an outside diameter that enables the auxiliary portion main body portion 42 to be brought into abutment with an end face of the inner pipe 12 while contacting an inner surface of the through hole 111 at the upper side of the case 1, and an injection opening 421 from which glass fiber 63 is injected is provided in a rear side surface of the auxiliary portion main body portion 42. In the apparatus for filling a silencer with glass fiber 2 according to the present example, since glass fiber 63 is supplied while the silencer 1 is being rotated, a direction in which glass fiber 63 is injected imposes no problem. In the present example, since the auxiliary portion main body portion 42 is the cylinder having the outside diameter that enables the auxiliary portion main body portion 42 to be brought into abutment with the inner surface of the through hole 111 at the upper side of the case 1, when the auxiliary portion main body portion 42 is inserted into the case from above through the through hole 111, the auxiliary portion main body portion 42 closes the through hole 111 as a through hole closing portion.

In the end portion 43, an upper half portion that continues to the auxiliary portion main body portion 42 constitutes a metallic cylinder having an outside diameter that enables the upper half portion to be brought into contact with an inner side of the inner pipe 12, and a lower half portion continuing from the upper half portion constitutes a metallic cone that projects downwards. In the end portion 43 of the present example, since the upper half portion is the cylinder having the outside diameter that enables the upper half portion to be brought into contact with the inner side of the inner pipe 12, when the end portion 43 is inserted from above, the end portion 43 can close one end of the inner pipe 12 as a one end closing portion. The lower half portion of the end portion 43 is made to be inserted into one end 121 of the inner pipe 12 in an ensured fashion. Due to this, as long as the lower half portion of the end portion 43 can be inserted into the one end of the inner pipe 12, the lower half portion does not have to be the cone.

Figure 8:
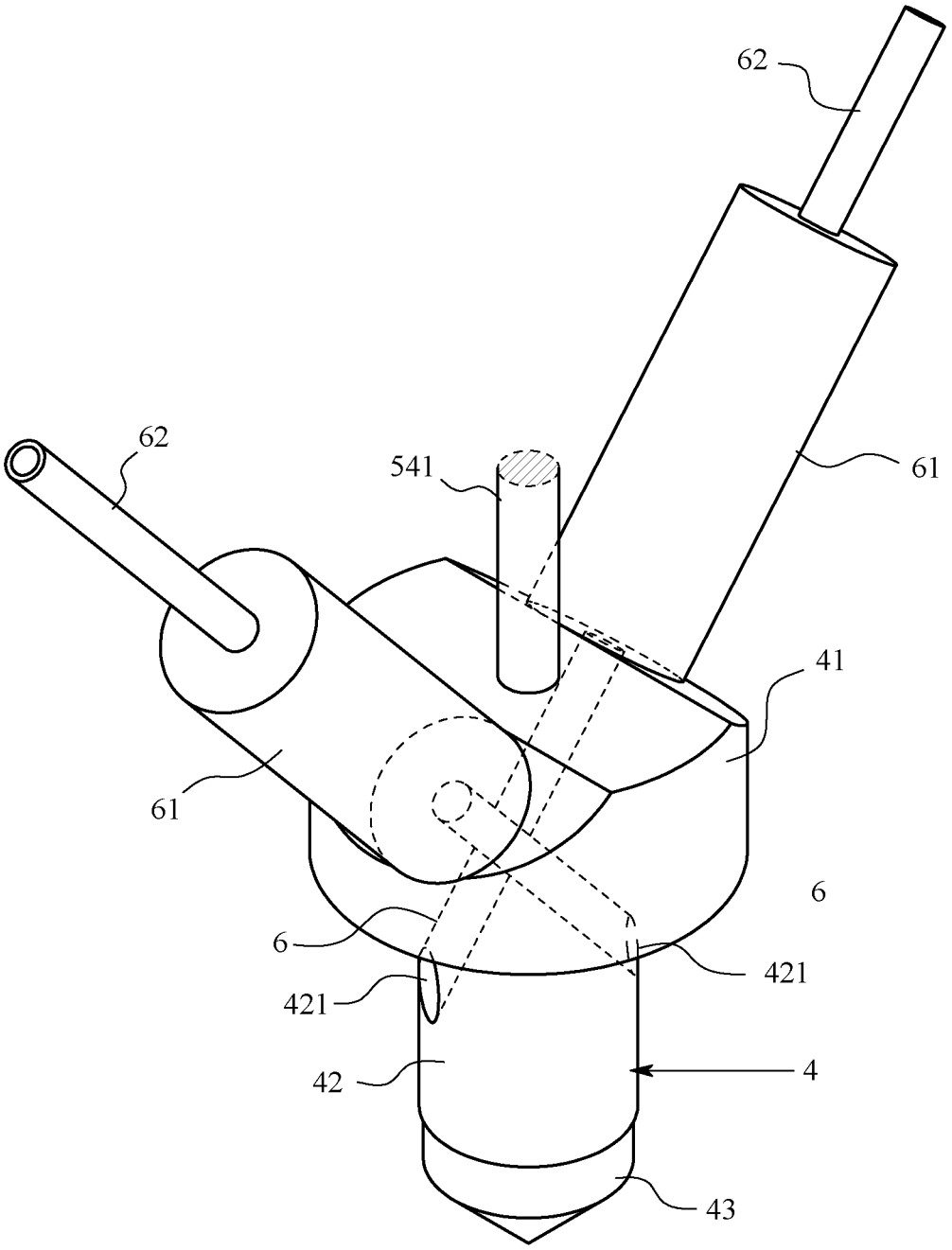
FIG. 8 is a perspective view of a nozzle auxiliary portion of another example of the apparatus for filling a silencer with glass fiber, as seen from the rear.

When the nozzle auxiliary portion 4 interferes with no other portions (for example, the horizontal arm 53), as illustrated in FIG. 8, two nozzles 6 can be inserted into the nozzle auxiliary portion 4 in a point symmetric positional relationship (another example). In this other example, chamfered portions are provided on a stopper portion 41 in positions which are bilaterally symmetric with each other in order for nozzle main body portions 61 of the nozzles 6 so provided to be brought into abutment with the stopper portion 41. Compared with the case where the apparatus for filling a silencer with glass fiber 2 includes the nozzle auxiliary portion 4 of the initial example, the apparatus for filling a silencer with glass fiber 2 that includes the nozzle auxiliary portion 4 of the other example comes to have a glass fiber supply capability which is twice the glass fiber supply capability provided by the nozzle auxiliary portion 4 of the initial example, whereby the filling time of the case 1 with glass fiber with the nozzle auxiliary portion 4 of the other example can be reduced to about a half the filling time provided by the nozzle auxiliary portion 4 of the initial example. Although illustration is omitted, more nozzles 6 may be provided in the nozzle auxiliary portion 4.

The nozzle 6 is such as used in an existing glass fiber supply machine and constitutes a metallic pipe that projects from the nozzle main body portion 61. The nozzle 6 of the present example is inserted obliquely downwards from the chamfered portion of the stopper portion 41 of the nozzle auxiliary portion 4 to penetrate through the auxiliary portion main body portion 42 to the injection opening 421 provided on the rear surface side of the auxiliary portion main body portion 42. The nozzle main body portion 61 includes a supply device of a transport gas (for example, air) for feeding glass fiber and a cutter for cutting continuous glass fiber 63 (both the supply device and the cutter are omitted from illustration). The glass fiber 63 is supplied to the nozzle main body portion 61 through a supply tube 62 and is injected from the nozzle 6 while being untwined.

The operator may activate or stop sequentially the constituent members of the apparatus for filling a silencer with glass fiber 2 according to the present example, that is, the linear cylinder 54 for lifting up and down the nozzle auxiliary portion 4, the turn table 33 for rotating the silencer support portion 3, the ball screw 352 for lifting up and down the pipe receiver 35, and the glass fiber supply machine in accordance with the working procedure. However, when the operator manually activates or stops the relevant operating portions, a procedure error is called for, or the cooperation among the relevant operating portions becomes insufficient, whereby the efficiency of the silencer filling operation using glass fiber is reduced. To cope with this problem, a controller needs to be provided so as to automatically activate or stop the relevant operating portions in accordance with the working procedure. The controller may include child controllers provided at the relevant operating portions, and the child controllers may be caused to cooperate with one another by the parent controller. Alternatively, the relevant operating portions may be controlled altogether directly by the parent controller.

Figure 11:
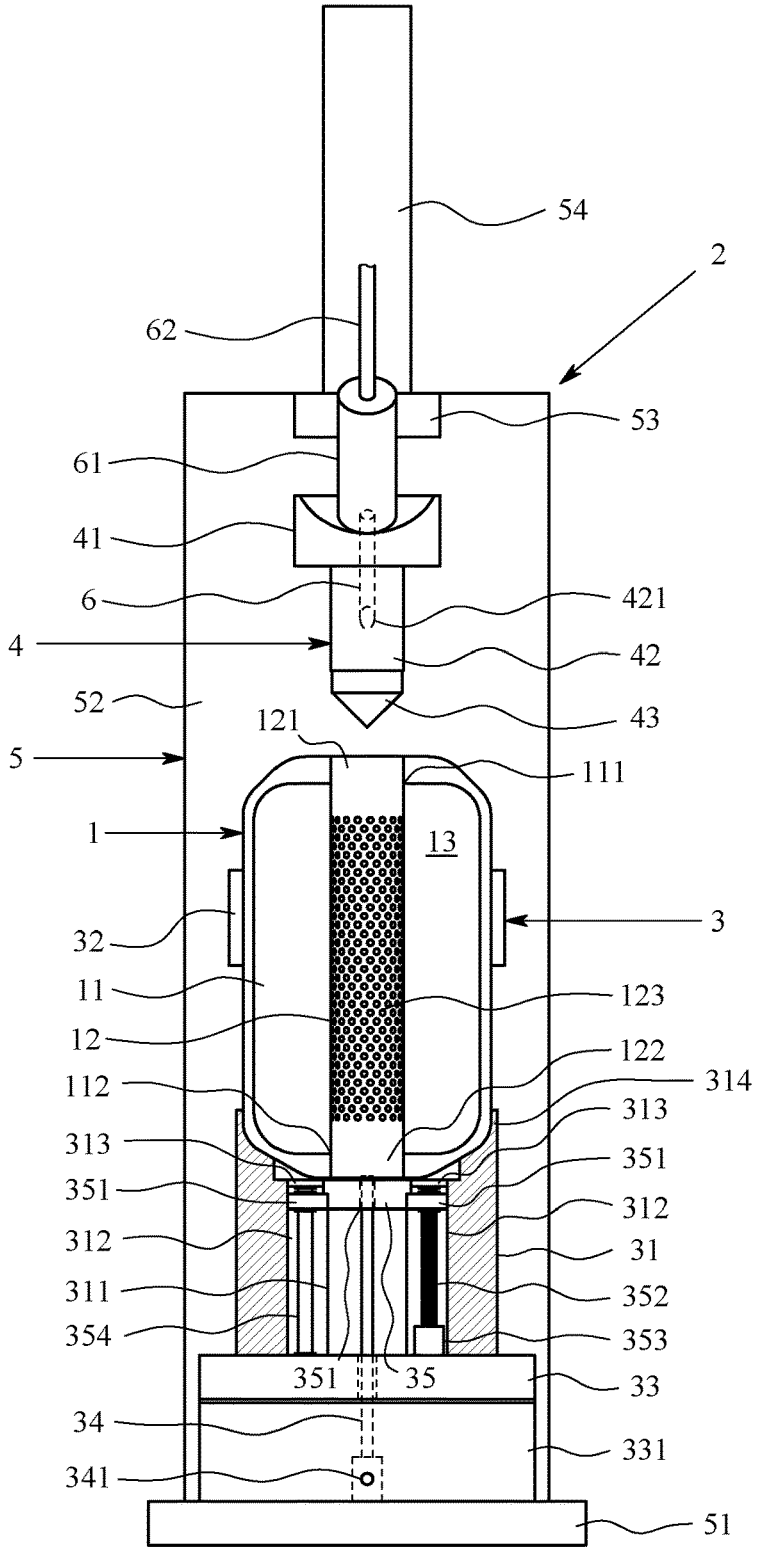
FIG. 11 is a partially cut away front view of the apparatus for filling a silencer with glass fiber according to the present example, representing a state where the silencer is rested on the silencer support portion.
Figure 12:
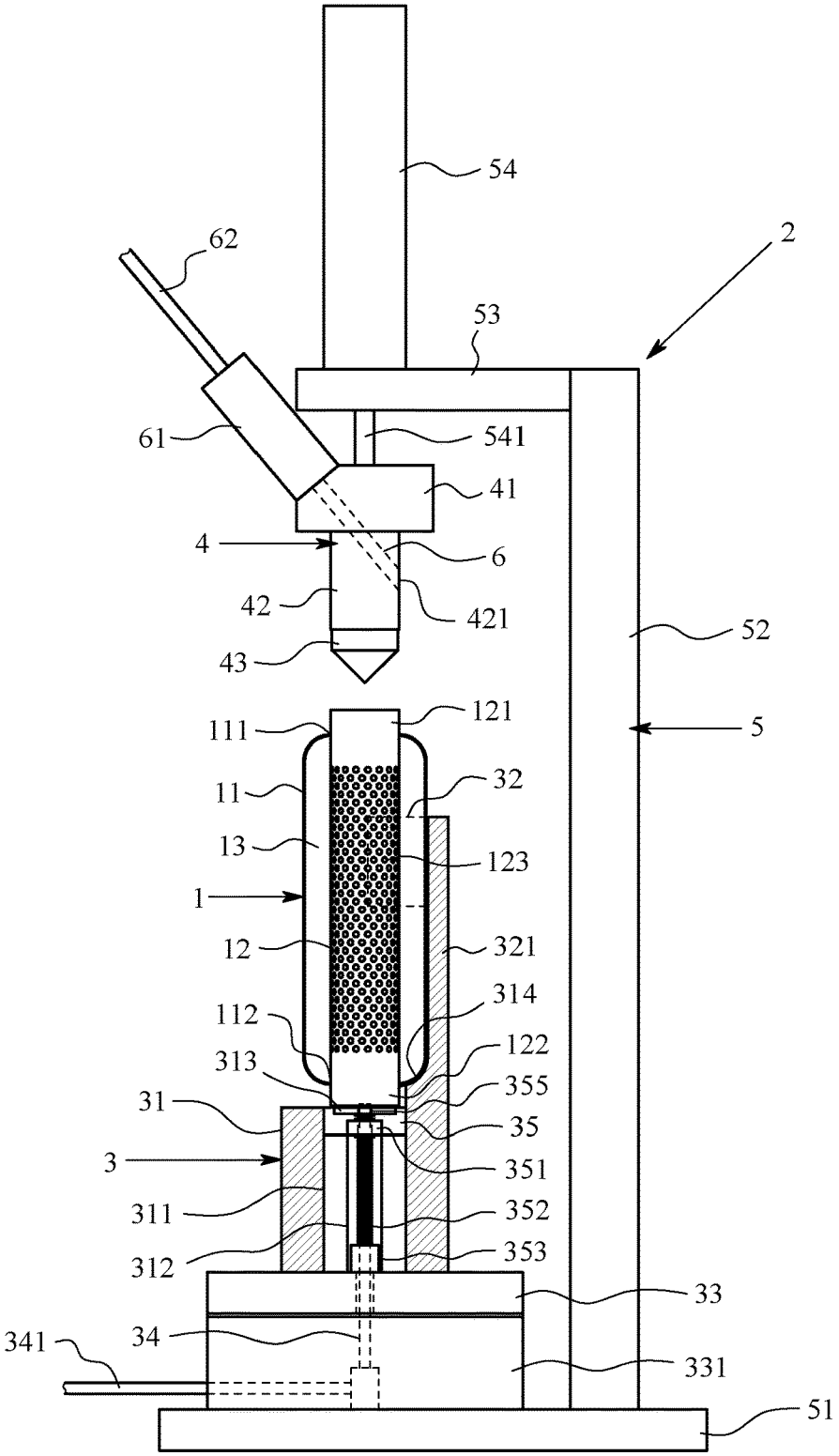
FIG. 12 is a partially cut away right side view of the apparatus for filling a silencer with glass fiber according to the present example, representing a state where the silencer is rested on the silencer support portion.

The filling operation of filling the silencer with glass fiber using the apparatus for filling a silencer with glass fiber 2 according to the present example will be described. Firstly, as illustrated in FIGS. 9 to 12, the silencer 1 in which the inner pipe 12 is caused to penetrate the through hole 111 and a through hole 112 of the case 11 is rested on the silencer support portion 3. The silencer 1 of the present example uses the case 11 having the separated outer shell structure in which a pair of metallic members is joined together along circumferential flanges. FIG. 11 illustrates an interior of the case 11 by removing a front member. The inner pipe 12 is a metallic pipe in which a number of holes 123 are provided. Even though the inner pipe 12 is situated in the normal position in a stage where the silencer 1 is rested on the silencer support portion 3, the inner pipe 12 is not secured to the case 11. A space defined between the case 11 and the inner pipe 12 constitutes an internal space 13 to be filled with glass fiber 14.

The silencer 1 is rested on the silencer support portion 3 in such a manner that the end face of the case 11 is brought into abutment with the case receiver 314 provided on the upper surface of the support table 31 and the side surfaces of the case 11 are held by the holding frame 32. In FIGS. 9 to 12, the silencer 1 is rested on the silencer support portion 3 in the erected posture with the flat case 11 aligned in such a manner that narrow side surfaces thereof are oriented in a left-right direction. However, as long as the silencer 1 is rested in the erected posture, there will be imposed no limitation on the direction in which the flat case 11 is oriented. The orientation of the silencer support portion 3 that specifies the orientation of the silencer 1 is controlled by the turn table 33. The nozzle auxiliary portion 4 is positioned directly above the silencer 1 rested on the silencer support portion 3. In this stage, a center axis C (refer to FIGS. 15 and 16, which will be described later on) of the inner pipe 12, axes of the nozzle auxiliary portion 4 and the support table 31 of the silencer support portion 3, and the rotational center of the turn table 33 coincide with one another.

Figure 13:
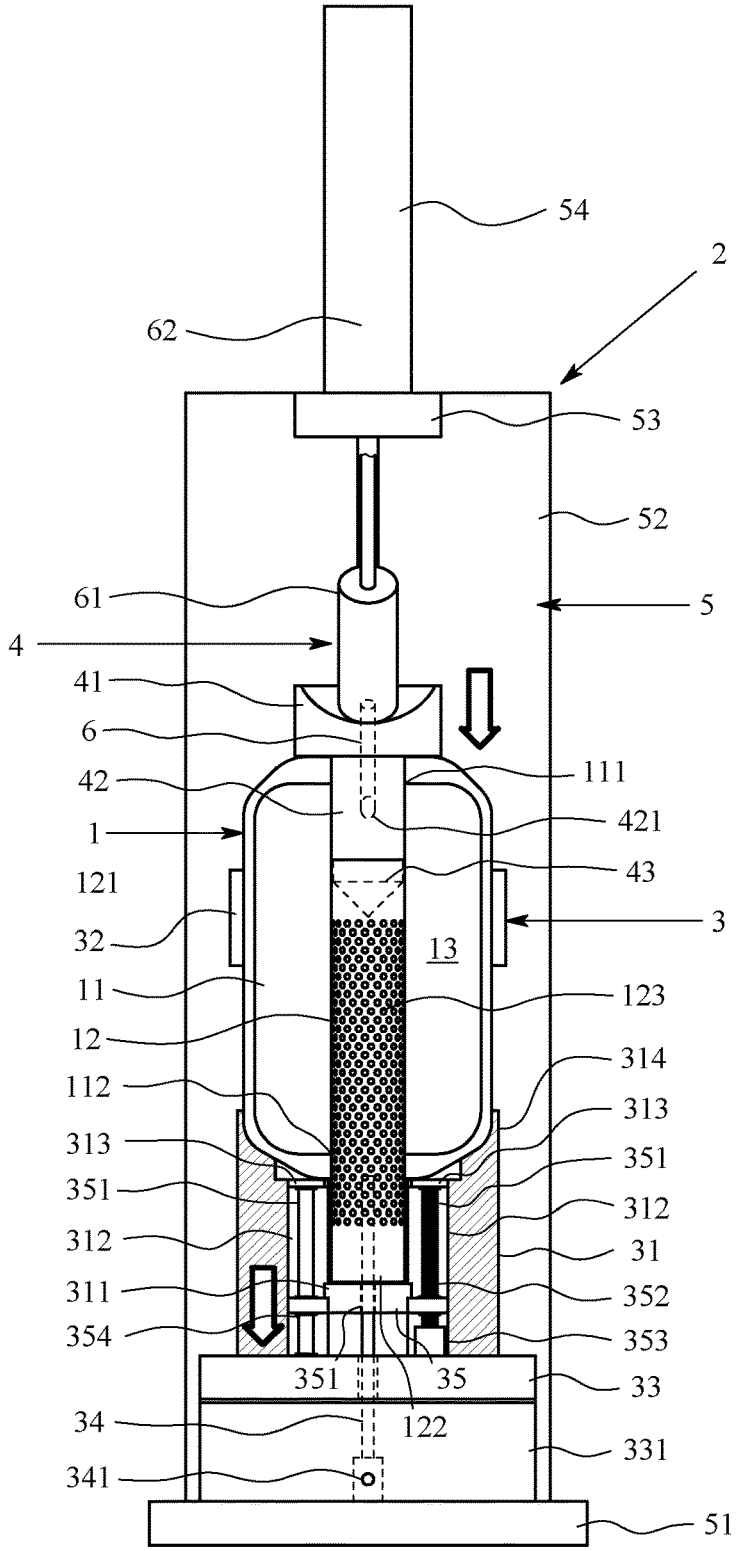
FIG. 13 is a partially cut away front view of the apparatus for filling a silencer with glass fiber according to the present example, representing a state where an inner pipe is shifted downwards, and the nozzle auxiliary portion is inserted into a case from a through hole provided at an upper side of the case.
Figure 14:
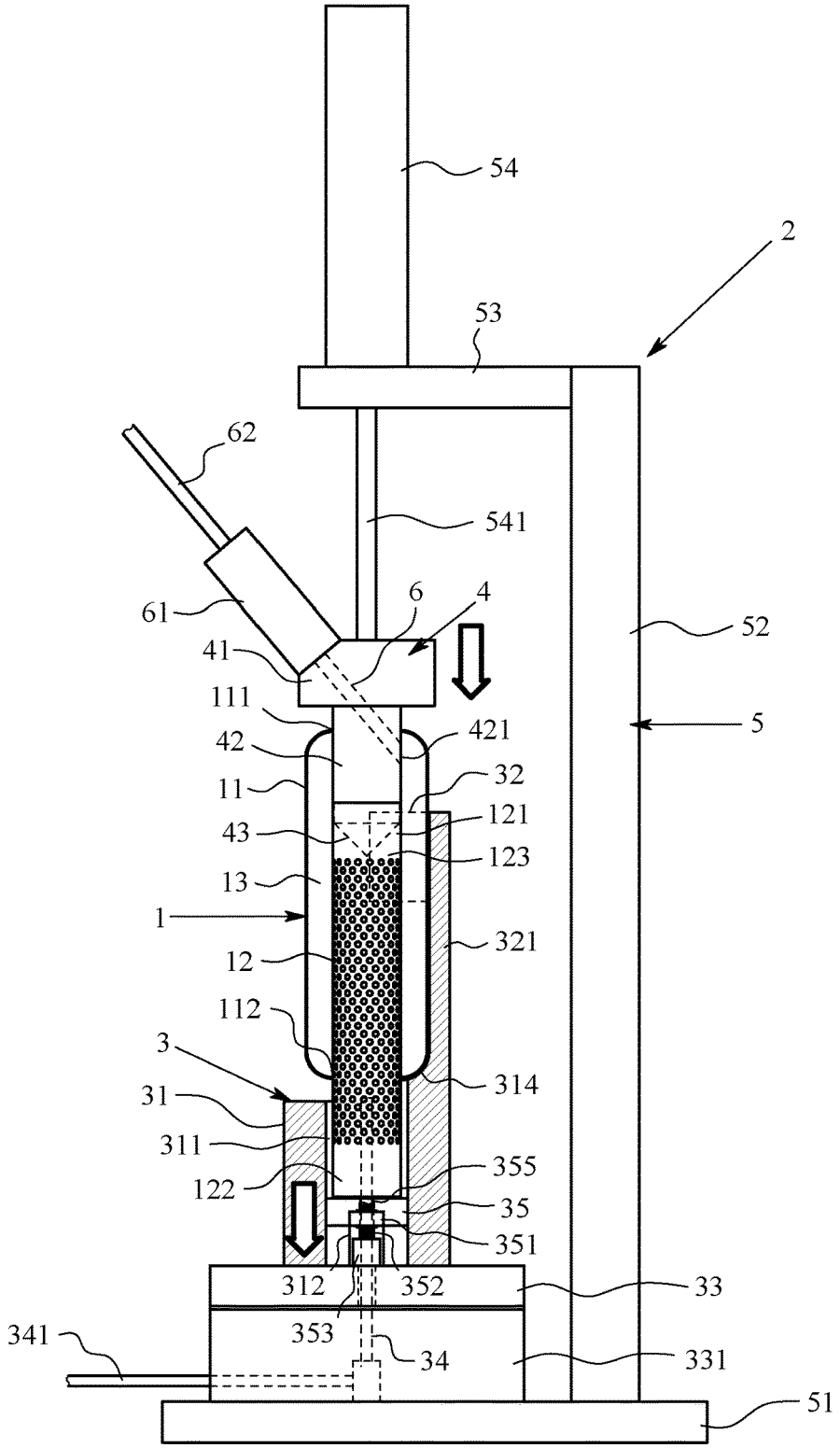
FIG. 14 is a right side view of the apparatus for filling a silencer with glass fiber according to the present example, representing a state where the inner pipe is shifted downwards, and the nozzle auxiliary portion is inserted into the case from the through hole provided at the upper side of the case.

After the silencer 1 is rested on the silencer support portion 3, as illustrated in FIGS. 13 and 14, the inner pipe 12 is shifted downwards from the normal position, and the nozzle auxiliary portion 4 is inserted from the through hole 111 at the upper side of the case 11, the through hole 111 being now opened. Since the inner pipe 12 is not secured to the case 11, when the pipe receiver 35 is lowered by rotating the ball screw 352, the inner pipe 12 is lowered by virtue of its own weight. When the pipe receiver 35 is lowered, shifting the inner pipe 12 downwards, the suction pipe 34 is inserted into an interior of the inner pipe 12 from the other end 122 thereof that is stated outside the case 11.

The nozzle auxiliary portion 4 is lowered as a result of the rod 541 of the direction action cylinder 54 being extended immediately after or at the same time as the pipe receiver 35 is lowered. Since the end portion 43 has the outside diameter that enables the end portion 43 to be brought into contact with the inner side of the inner pipe 12, the end portion 43 is inserted into the through hole 111, which has a diameter equal to the outside diameter of the inner pipe 12, at the upper side of the case 11 without any difficulty. Even though the inner pipe 12 deviates in a horizontal direction or is inclined, when the end portion 43 is inserted into the one end of the inner pipe 12, the erroneous posture of the inner pipe 12 is corrected. The end portion 43 is inserted into the one end 121 of the inner pipe 12 that is situated in the interior of the case 11 to thereby close the one end 121. In the present example, a step constituting a boundary between the end portion 43 and the auxiliary portion main body portion 42 is brought into abutment with an end face of the one end 121 of the inner pipe 12 to thereby enhance the airtightness at the one end 121.

When the end portion 43 is inserted into the one end 121 of the inner pipe 12, the auxiliary portion main body portion 42 is inserted into the through hole 111 at the upper side of the case 11 and closes the through hole 111. The nozzle auxiliary portion 4 stops lowering when the stopper portion 41 is brought into abutment with the case 11. In the present example, since the stopper portion 41 is brought into abutment with the flange of the case 11, the stopper portion 41 never enhances the airtightness of the upper through hole 111, and hence, the auxiliary portion main body portion 42 closes the through hole 111 in such a state that a slight amount of air is allowed to be sucked in. As a result, when air is sucked in from the suction pipe 34, a flow of air directed downwards is formed while a slight amount of air is being sucked in from a gap between the through hole 111 and the auxiliary portion main body portion 42 inserted therein.

In the apparatus for filling a silencer with glass fiber 2 according to the present example, glass fiber 63 is supplied while the silencer 1 is being rotated and air is being sucked out from the suction pipe 34, whereby glass fiber 14 fills the internal space 13 that changes in the rotating direction of the silencer 1 uniformly in the circumferential direction and with high bulk density. Due to this, the silencer support portion 3 is rotated by the turn table 33 after the inner pipe 12 of the silencer 1 is shifted downwards. As a result, in the silencer 1 in an erected state with the inner pipe 12 shifted downwards, the case 11 and the inner pipe 12 are rotated integrally.

The inner pipe 12 is connected rotatably with the end portion 43 of the nozzle auxiliary portion 4 at the one end 111 thereof. Additionally, the inner pipe 12 is connected rotatably at the other end 122 thereof with the lifting hole 311 emerging by the pipe receiver 35 being lowered. In the case 11, the auxiliary portion main body portion 42 of the nozzle auxiliary portion 4 is inserted into the upper through hole 111, and the inner pipe 12 penetrates through the lower through hole 112. The turn table 33 turns around the center axis C of the inner pipe 12. Thus, the case 11 and the inner pipe 12 rotate around the center axis C of the inner pipe 12 without being dislocated from the silencer support portion 3.

Figure 15:
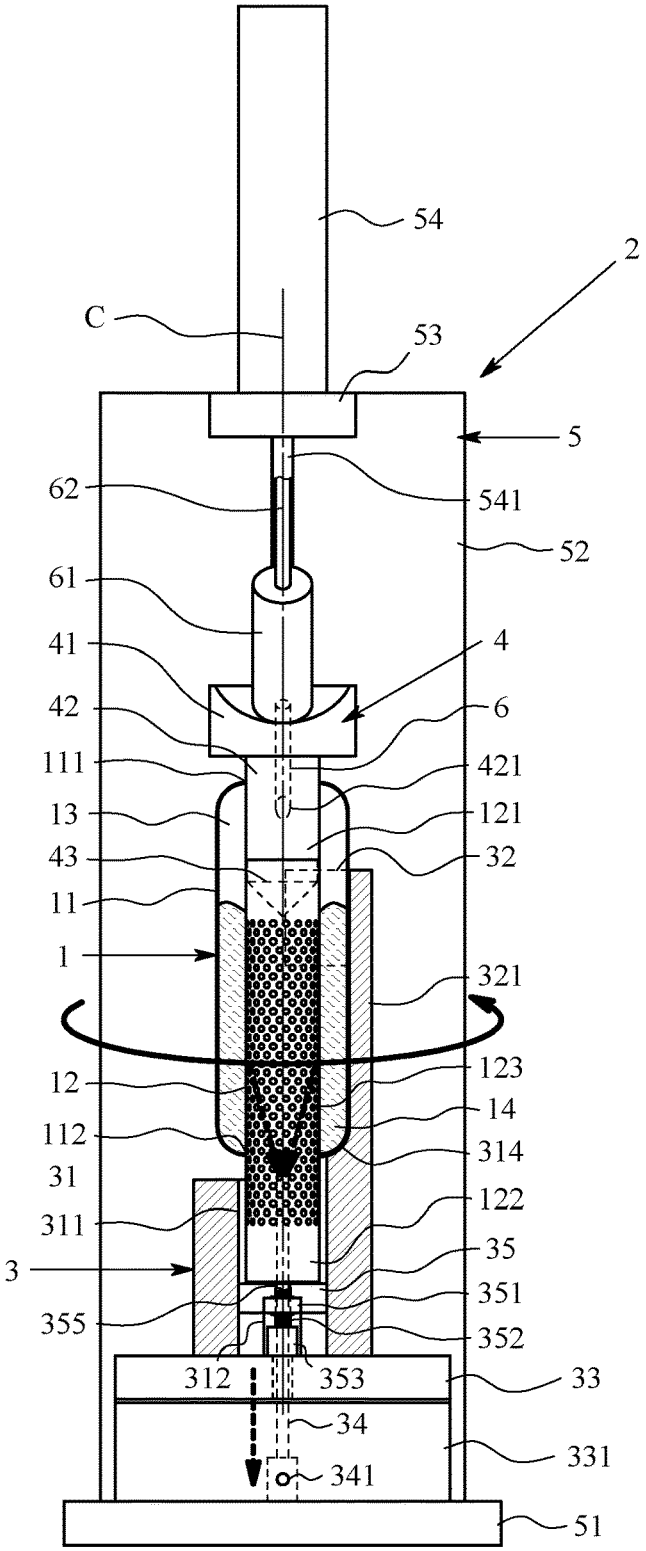
FIG. 15 is a partially cut away front view of the apparatus for filling a silencer with glass fiber according to the present example, representing a state where glass fiber is supplied while the silencer is being rotated.
Figure 16:
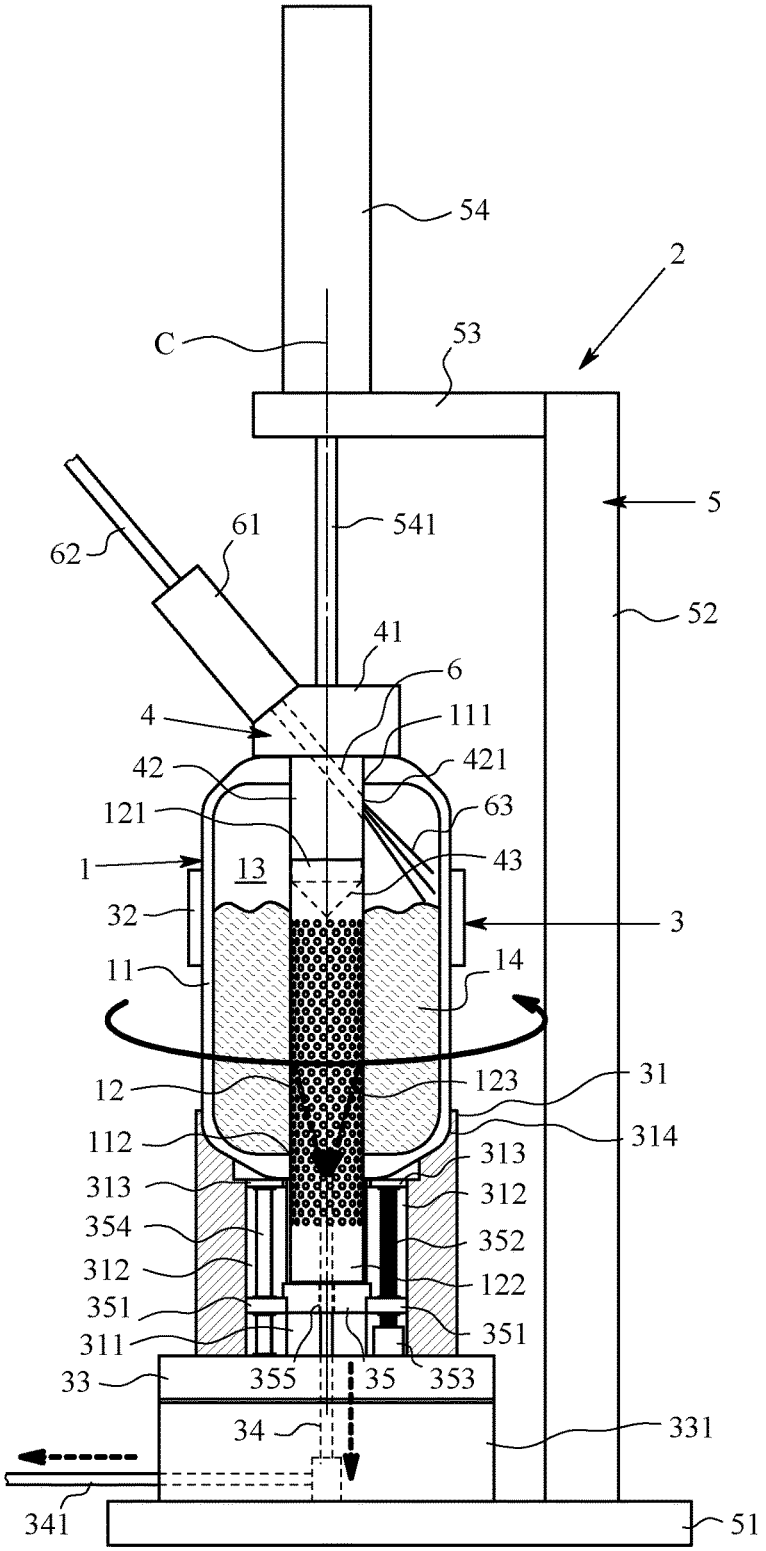
FIG. 16 is a partially cut away right side view of the apparatus for filling a silencer with glass fiber according to the present example, representing a state where glass fiber is supplied while the silencer is being rotated.

As illustrated in FIGS. 15 and 16, the nozzle 6 injects glass fiber 63 while untwining the glass fiber to supply the glass fiber 63 into the internal space 13 of the silencer 1 that is rotating. In the interior of the case 11, a flow of air directed downwards from the internal space 13 is formed through the holes 123 on the inner pipe 12 as a result of air being sucked out from the suction pipe 34 inserted from the other end 122 of the inner pipe 12 (refer to a broken line arrow in FIGS. 15 and 16). As a result, glass fiber 14 that is filling the internal space 13 is accumulated from a lower portion of the case 11 in a compressed state.

The rotation of the silencer 1 evens the bulk density of glass fiber 14 that fills the internal space 13 that changes in the circumferential direction. Specifically, the bulk density of glass fiber 14 filling the internal space 13 is made even although the internal space 13 changes in the circumferential direction by increasing or decreasing the amount of glass fiber 63 injected from the nozzle 6 in accordance with a rotation angle of the silencer 1. In addition, the bulk density of glass fiber 14 filling the internal space 13 is made even although the internal space 13 changes in the circumferential direction by increasing or decreasing the rotation speed of the silencer 1 while keeping the amount of glass fiber 63 injected from the nozzle 6 constant.

For example, in the case of the silencer 1 of the present example in which the internal space 13 has a capacity of just less than five liters, the filling time becomes 15 seconds when glass fiber 63 is supplied from the nozzle 6 at a rate of 260 g/min and the silencer 1 is rotated at an average rotation speed of 200 rpm. The filling time does not stay constant since the amount of glass fiber 63 injected from the nozzle 6 and the rotation speed of the silencer 1 need to be increased or decreased in accordance with the shape of the case 11. However, even if the filling time becomes double the filling time described above (15 seconds), the filling operation of filling the internal space 13 with glass fiber by making use of the present disclosure provides a very high operation efficiency with which substantially one minute is spent from the installation of the silencer 1 in the apparatus for filling a silencer with glass fiber 2 to the removal of the silencer 1 from the same apparatus 2.

When filling the internal space 13 with glass fiber 14 is completed, the supply of glass fiber 63 by the nozzle 6, the suction of air by the suction pipe 34, and the rotation of the silencer 1 are stopped. The glass fiber 14 that fills the internal space 13 is compressed to stay below the injection opening 421 provided in the auxiliary portion main body portion 42 of the nozzle auxiliary portion 4 by the flow of air formed by the suction pipe 34, leaving a slight space above the injection opening 421 in the internal space 13. However, when the suction of air by the suction pipe 34 is stopped, the glass fiber 14 filling the internal space 13 in such a compressed state expands to fill the whole of the internal space 13 while being distributed uniformly therein.

The nozzle 6 includes the cutter that is incorporated in the nozzle main body portion 61 to cut glass fiber 63 (a figure illustrating the cutter is omitted). Pieces of glass fiber 63 cut by the cutter are sucked into the internal space 13 as long as air continues to be sucked out by the suction pipe 34. Due to this, the suction of air by the suction pipe 34 is stopped after the supply of glass fiber 63 is stopped. Then, the silencer 1 is stopped rotating after the suction of air by the suction pipe 34 is stopped. Although the silencer 1 can freely be stopped in any orientation, the silencer need only be stopped in the same orientation as that in which the silencer 1 is oriented when it is rested on the silencer support portion 3 (to the front in the present example).

Figure 17:
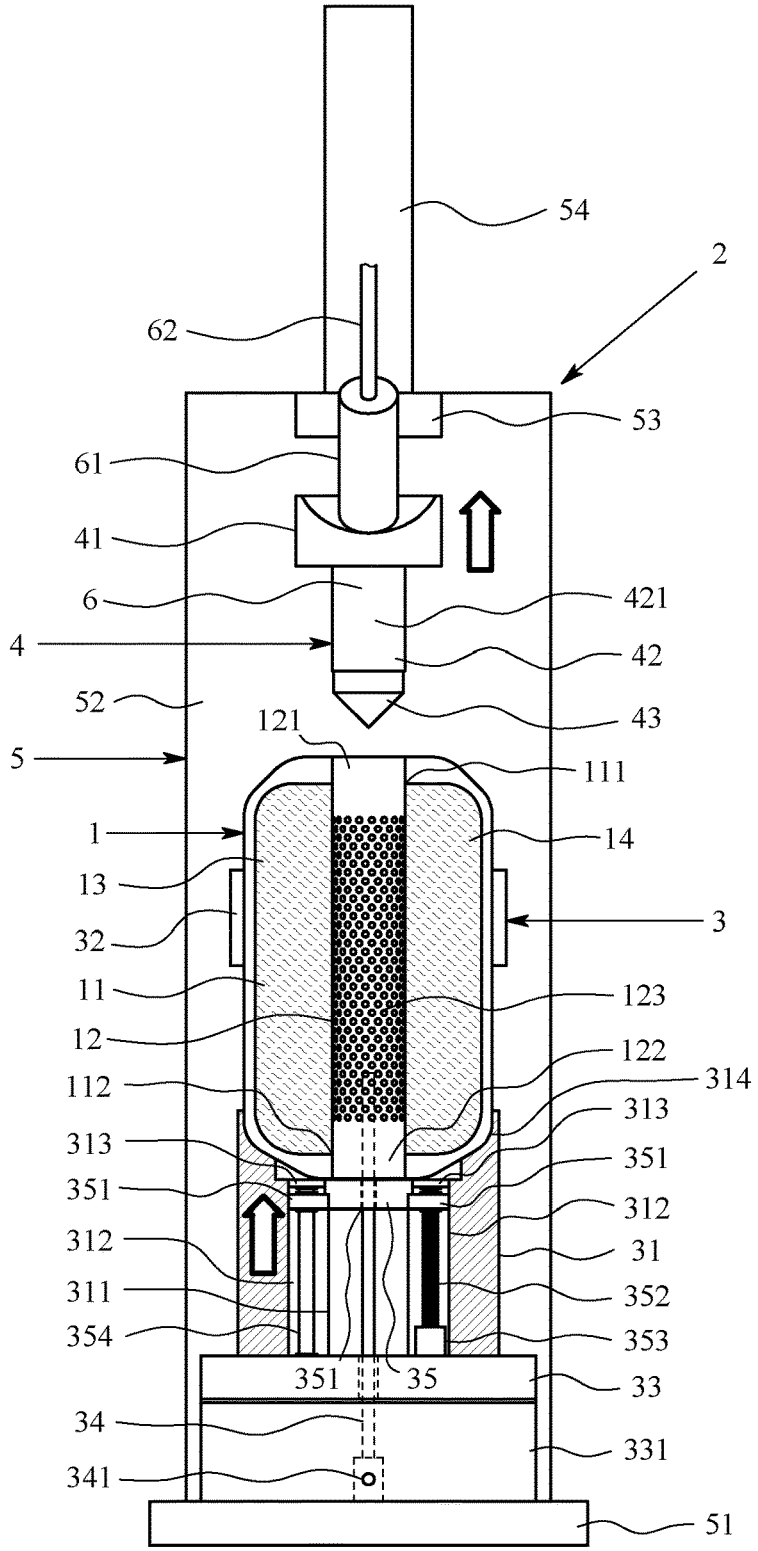
FIG. 17 is a partially cut away front view of the apparatus for filling a silencer with glass fiber according to the present example, representing a state where the silencer is completely filled with glass fiber.
Figure 18:
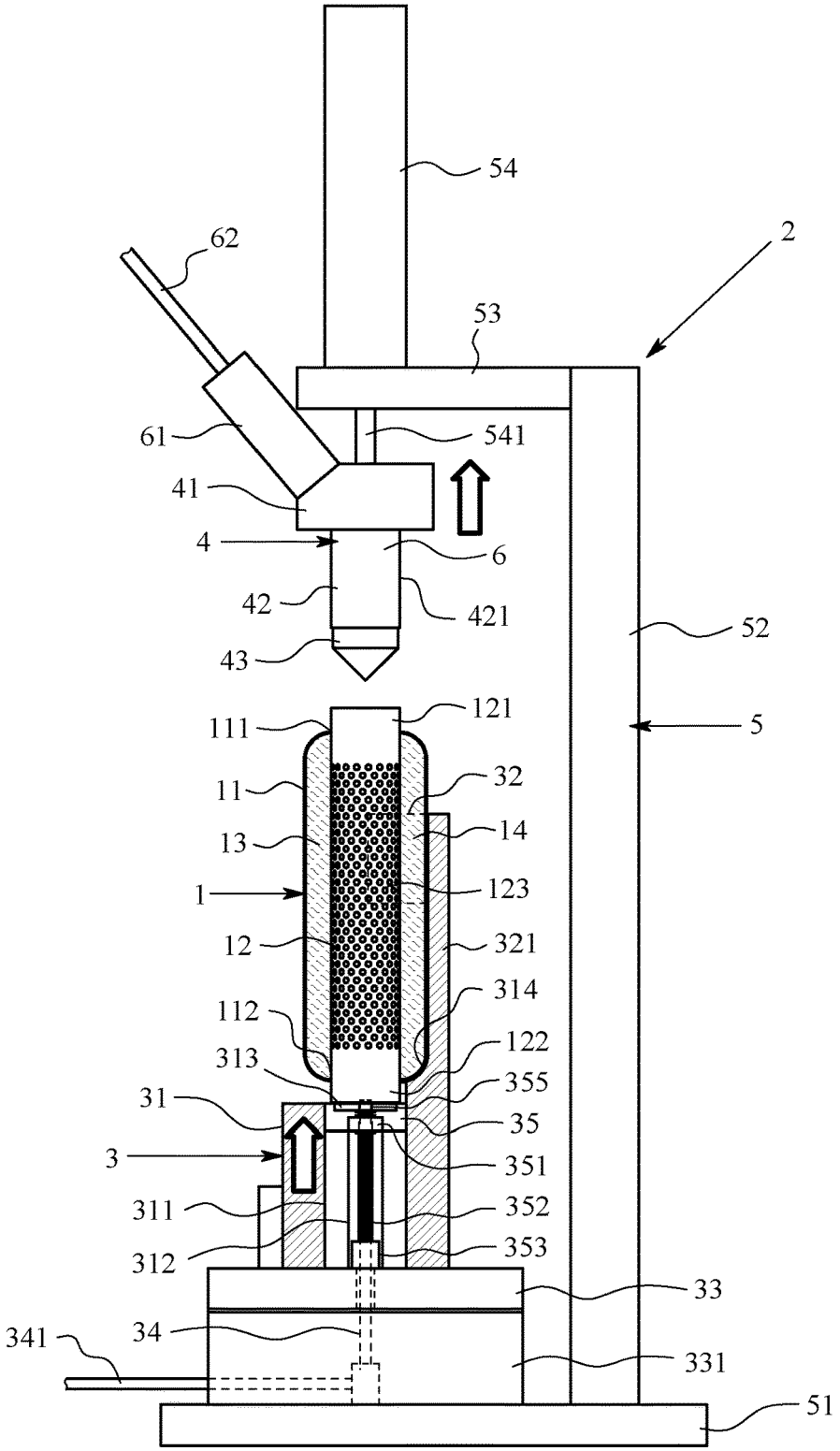
FIG. 18 is a partially cut away right side view of the apparatus for filling a silencer with glass fiber according to the present example, representing a state where the silencer is completely filled with glass fiber.

When the silencer 1 is stopped rotating, as illustrated in FIGS. 17 and 18, the nozzle auxiliary portion 4 is raised to be withdrawn from the through hole 111 in the case 11, and at the same time, the pipe receiver 35 is raised to return the inner pipe 12 to the normal position. At this time, when the nozzle auxiliary portion 4 is raised before the inner pipe 12 is returned to the normal position, a gap is produced between the one end 121 of the inner pipe 12 and the through hole 111 at the upper side of the case 11, whereby the glass fiber 14 that is expanding forcibly enters the gap so produced, causing fears that the inner pipe 12 is prevented from rising. Due to this, the nozzle auxiliary portion 4 and the inner pipe 12 need only be raised at the same time.

When the nozzle auxiliary portion 4 and the pipe receiver 35 are raised in synchronism with each other, the nozzle auxiliary portion 4 is pulled out of the through hole 111 at the upper side of the case 11 with the end portion 43 left inserted in the one end 121 of the inner pipe 12. Additionally, when the pipe receiver 35 is raised with the rod 541 of the linear cylinder 54 left in a free state, since the nozzle auxiliary portion 4 is pushed up by the pipe receiver 35 via the inner pipe 12, the nozzle auxiliary portion 4 is pulled out of the through hole 111 at the upper side of the case 11 with the end portion 43 left inserted in the one end 121 of the inner pipe 12. When the nozzle auxiliary portion 4 continues to be raised further even after the pipe receiver 35 is stopped, the end portion 43 is pulled out of the one end 121 of the inner pipe 12, whereby the nozzle auxiliary portion 4 can be withdrawn upwards.

When the nozzle auxiliary portion 4 is withdrawn upwards, and the inner pipe 12 is returned to the normal position, the silencer 1 can simply be removed from the silencer support portion 3. The silencer 1 is completed by securing the inner pipe 12 to the case 11 after the operation of filling the silencer 1 with glass fiber 14 is completed. No opening is provided in the case 11 to supply glass fiber to fill the case 11. In this way, according to the present disclosure, the silencer 1 whose internal space 13 is filled with the glass fiber 14 can simply be fabricated without providing any opening visible from the external appearance of the silencer 1.

REFERENCE SIGNS LIST

1 silencer
11 case
111 upper through hole
112 lower through hole
12 inner pipe
121 one end
122 the other end
13 internal space
14 glass fiber supplied to fill the case
2 apparatus for filling a silencer with glass fiber
3 silencer support portion
31 support table
32 holding frame
33 turn table
34 suction pipe
341 suction tube
35 pipe receiver
4 nozzle auxiliary portion
41 stopper portion
42 auxiliary portion main body portion
43 end portion
5 apparatus frame
51 base
52 vertical wall
53 horizontal arm
54 direction action cylinder
6 nozzle
61 nozzle main body portion
62 supply tube
63 supplied glass fiber
C center axis of inner pipe

What is claimed is:

1. A method for filling a silencer with glass fiber, for filling an internal space between a case and an inner pipe with glass fiber in a silencer in which a porous inner pipe penetrates through a pair of through holes in the case, the method comprising:

shifting the inner pipe in a penetrating direction from a normal position where the inner pipe is secured to the case;

inserting a nozzle auxiliary portion into an interior of the case from a through hole opened by the inner pipe being shifted;

supplying glass fiber into the interior of the case from a nozzle of a glass fiber supply machine connected to the nozzle auxiliary portion; and filling the internal space between the case and the inner pipe with glass fiber.

2. The method for filling a silencer with glass fiber according to claim 1, wherein when inserted into the interior of the case from the through hole, the nozzle auxiliary portion is detachably connected to one end of the inner pipe that is situated in the interior of the case.

3. The method for filling a silencer with glass fiber according to claim 1, wherein when inserted into the interior of the case from the through hole, the nozzle auxiliary portion is detachably connected to the through hole in the case that is opened by shifting the inner pipe.

4. The method for filling a silencer with glass fiber according to claim 1, wherein when inserted into the interior of the case from the through hole, the nozzle auxiliary portion closes the one end of the inner pipe that is situated in the interior of the case and the through hole in the case that is opened by shifting the inner pipe and forms a flow of air for sucking in glass fiber by sucking out air in the interior of the case through holes on the inner pipe from the other end of the inner pipe that is situated outside the case to supply glass fiber from the nozzle.

5. The method for filling a silencer with glass fiber according to claim 1, wherein in supplying glass fiber from the nozzle, the case and the inner pipe are rotated around a center axis of the inner pipe.

6. An apparatus for filling a silencer with glass fiber, for filling an internal space between a case and an inner pipe with glass fiber in a silencer in which a porous inner pipe penetrates through a pair of through holes in the case, the apparatus comprising:

a silencer support portion configured to hold the case and the inner pipe in such a state that the inner pipe is directed in an up-down direction and is shifted downwards from a normal position where the inner pipe is secured to the case to take an erected posture; and a nozzle auxiliary portion that is inserted into an interior of the case from above through a through hole opened by the inner pipe being shifted, the silencer support portion and the nozzle auxiliary portion being provided on an apparatus frame, wherein a nozzle of a glass fiber supply machine is connected to the nozzle auxiliary portion.

7. The apparatus for filling a silencer with glass fiber according to claim 6, wherein the silencer support portion comprises a support table configured to support from below the other end of the inner pipe that is situated outside the case and a bottom surface of the case and a holding frame configured to hold a side surface of the case.

8. The apparatus for filling a silencer with glass fiber according to claim 6, wherein the silencer support portion is provided on the apparatus frame via a support portion rotating device and is rotated around a center axis of the inner pipe by the support portion rotating device.

9. The apparatus for filling a silencer with glass fiber according to claim 6, wherein the silencer support portion comprises a pipe receiver configured to support from below the other end of the inner pipe that is situated outside the case, and wherein the pipe receiver comprises a pipe lifting device configured to rise in returning the inner pipe to the normal position.

10. The apparatus for filling a silencer with glass fiber according to claim 6, wherein the nozzle auxiliary portion is provided on the apparatus frame via an auxiliary portion lifting device and is lifted down towards the through hole in the case that is opened by the inner pipe being shifted by the auxiliary portion lifting device.

11. The apparatus for filling a silencer with glass fiber according to claim 6, wherein the nozzle auxiliary portion comprises a one end closing portion configured to close one end of the inner pipe that is situated in an interior of the case and a through hole closing portion configured to close the through hole in the case that is opened by shifting the inner pipe, wherein the silencer support portion comprises an air suction device that communicates with the other end of the inner pipe that is situated outside the case, and wherein in supplying glass fiber from the nozzle, air in the interior of the case is sucked out via holes in the inner pipe by the air suction device to form a flow of air for sucking glass fiber in such a state that the nozzle auxiliary portion closes the one end of the inner pipe that is situated in the interior of the case by use of the one end closing portion and the through hole in the case that is opened by shifting the inner pipe by use of the through hole closing portion.

* * * * *